US008800848B2

(12) United States Patent
Mirchandani et al.

(10) Patent No.: US 8,800,848 B2
(45) Date of Patent: Aug. 12, 2014

(54) METHODS OF FORMING WEAR RESISTANT LAYERS ON METALLIC SURFACES

(75) Inventors: Prakash K. Mirchandani, Houston, TX (US); Morris E. Chandler, Santa Fe, TX (US)

(73) Assignee: Kennametal Inc., Latrobe, PA (US)

( * ) Notice: Subject to any disclaimer, the term of this patent is extended or adjusted under 35 U.S.C. 154(b) by 232 days.

(21) Appl. No.: 13/222,324

(22) Filed: Aug. 31, 2011

(65) Prior Publication Data

US 2013/0048701 A1 Feb. 28, 2013

(51) Int. Cl.
*B23K 31/02* (2006.01)
*B22D 23/06* (2006.01)

(52) U.S. Cl.
USPC ..... 228/121; 164/80; 419/8

(58) Field of Classification Search
USPC ..... 228/121
See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,240,840 | A | 5/1941 | Fischer |
| 2,246,237 | A | 6/1941 | Benninghoff |
| 2,283,280 | A | 5/1942 | Nell |
| 2,299,207 | A | 10/1942 | Bevillard |
| 2,351,827 | A | 6/1944 | McAllister |
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |

(Continued)

FOREIGN PATENT DOCUMENTS

| | | |
|---|---|---|
| AU | 695583 | 2/1998 |
| CA | 1018474 A | 10/1977 |

(Continued)

OTHER PUBLICATIONS

Nassau, K. Ph.D. and Julia Nassau, "The History and Present Status of Synthetic Diamond, Part I and II", reprinted from The Lapidary Journal, Inc., vol. 32, No. 1, Apr. 1978; vol. 32, No. 2, May 1978, 15 pages.

(Continued)

*Primary Examiner* — Kiley Stoner
(74) *Attorney, Agent, or Firm* — Larry R. Meenan, Esq.

(57) ABSTRACT

Methods for forming a wear resistant layer metallurgically bonded to at least a portion of a surface of a metallic substrate may generally comprise positioning hard particles adjacent the surface of the metallic substrate, and infiltrating the hard particles with a metallic binder material to form a wear resistant layer metallurgically bonded to the surface. In certain embodiments of the method, the infiltration temperature may be 50° C. to 100° C. greater than a liquidus temperature of the metallic binder material. The wear resistant layer may be formed on, for example, an exterior surface and/or an interior surface of the metallic substrate. Related wear resistant layers and articles of manufacture are also described.

51 Claims, 6 Drawing Sheets

(56) References Cited

U.S. PATENT DOCUMENTS 3,041,641 A 7/1962 Hradek et al.
3,093,850 A 6/1963 Kelso
3,368,881 A 2/1968 Abkowitz et al.
3,471,921 A 10/1969 Feenstra
3,482,295 A 12/1969 Trent
3,490,901 A 1/1970 Hachisuka et al.
3,581,835 A 6/1971 Stebley
3,629,887 A 12/1971 Urbanic
3,660,050 A 5/1972 Iler et al.
3,757,879 A 9/1973 Wilder et al.
3,760,863 A * 9/1973 Weyersberg ..... 164/127
3,762,882 A 10/1973 Grutza
3,776,655 A 12/1973 Urbanic
3,782,848 A 1/1974 Pfeifer
3,806,270 A 4/1974 Tanner et al.
3,812,548 A 5/1974 Theuerkaue
3,855,444 A 12/1974 Palena
3,889,516 A 6/1975 Yankee et al.
RE28,645 E 12/1975 Aoki et al.
3,936,295 A 2/1976 Cromwell et al.
3,942,954 A 3/1976 Frehn
3,980,549 A 9/1976 Grutza
3,987,859 A 10/1976 Lichte
4,009,027 A 2/1977 Naidich et al.
4,017,480 A 4/1977 Baum
4,047,828 A 9/1977 Makely
4,094,709 A 6/1978 Rozmus
4,097,180 A 6/1978 Kwieraga
4,097,275 A 6/1978 Horvath
4,105,049 A 8/1978 Anderson
4,106,382 A 8/1978 Salje et al.
4,126,652 A 11/1978 Oohara et al.
4,128,136 A 12/1978 Generoux
4,170,499 A 10/1979 Thomas et al.
4,181,505 A 1/1980 De Vries et al.
4,198,233 A 4/1980 Frehn
4,221,270 A 9/1980 Vezirian
4,229,638 A 10/1980 Lichte
4,233,720 A 11/1980 Rozmus
4,255,165 A 3/1981 Dennis et al.
4,270,952 A 6/1981 Kobayashi
4,276,788 A 7/1981 van Nederveen
4,277,106 A 7/1981 Sahley
4,277,108 A 7/1981 Wallace
4,306,139 A 12/1981 Shinozaki et al.
4,311,490 A 1/1982 Bovenkerk et al.
4,325,994 A 4/1982 Kitashima et al.
4,327,156 A 4/1982 Dillon et al.
4,331,741 A 5/1982 Wilson
4,340,327 A 7/1982 Martins
4,341,557 A 7/1982 Lizenby
4,351,401 A 9/1982 Fielder
4,376,793 A 3/1983 Jackson
4,389,952 A 6/1983 Dreier et al.
4,396,321 A 8/1983 Holmes
4,398,952 A 8/1983 Drake
4,423,646 A 1/1984 Berhardt
4,435,359 A * 3/1984 Eiselstein et al. ..... 419/3
4,470,953 A * 9/1984 Bruce ..... 419/6
4,478,297 A 10/1984 Radtke
4,497,358 A * 2/1985 Gnadig et al. ..... 164/80
4,499,048 A 2/1985 Hanejko
4,499,795 A 2/1985 Radtke
4,520,882 A 6/1985 van Nederveen
4,526,748 A 7/1985 Rozmus
4,547,104 A 10/1985 Holmes
4,547,337 A 10/1985 Rozmus
4,550,532 A 11/1985 Fletcher, Jr. et al.
4,552,232 A 11/1985 Frear
4,553,615 A 11/1985 Grainger
4,554,130 A 11/1985 Ecer
4,562,990 A 1/1986 Rose
4,574,011 A 3/1986 Bonjour et al.
4,579,713 A 4/1986 Lueth
4,587,174 A 5/1986 Yoshimura et al.
4,592,685 A 6/1986 Beere
4,596,694 A 6/1986 Rozmus
4,597,456 A 7/1986 Ecer
4,597,730 A 7/1986 Rozmus
4,604,106 A 8/1986 Hall
4,604,781 A 8/1986 Rankin, III
4,605,343 A 8/1986 Hibbs, Jr. et al.
4,609,577 A 9/1986 Long
4,630,693 A 12/1986 Goodfellow
4,642,003 A 2/1987 Yoshimura
4,649,086 A 3/1987 Johnson
4,656,002 A 4/1987 Lizenby et al.
4,662,461 A 5/1987 Garrett
4,667,756 A 5/1987 King et al.
4,686,080 A 8/1987 Hara et al.
4,686,156 A 8/1987 Baldoni, II et al.
4,694,919 A 9/1987 Barr
4,708,542 A 11/1987 Emanuelli
4,722,405 A 2/1988 Langford
4,729,789 A 3/1988 Ide et al.
4,734,339 A 3/1988 Schachner et al.
4,735,656 A 4/1988 Schaefer et al.
4,743,515 A 5/1988 Fischer et al.
4,744,943 A 5/1988 Timm
4,749,053 A 6/1988 Hollingshead
4,752,159 A 6/1988 Howlett
4,752,164 A 6/1988 Leonard, Jr.
4,761,844 A 8/1988 Turchan
4,779,440 A 10/1988 Cleve et al.
4,780,274 A 10/1988 Barr
4,804,049 A 2/1989 Barr
4,809,903 A 3/1989 Eylon et al.
4,813,823 A 3/1989 Bieneck
4,831,674 A 5/1989 Bergstrom et al.
4,838,366 A 6/1989 Jones
4,861,350 A 8/1989 Phaal et al.
4,871,377 A 10/1989 Frushour
4,881,431 A 11/1989 Bieneck
4,884,477 A 12/1989 Smith et al.
4,889,017 A 12/1989 Fuller et al.
4,899,838 A 2/1990 Sullivan et al.
4,919,013 A 4/1990 Smith et al.
4,923,512 A 5/1990 Timm et al.
4,934,040 A 6/1990 Turchan
4,943,191 A 7/1990 Schmidtt
4,956,012 A 9/1990 Jacobs et al.
4,968,348 A 11/1990 Abkowitz et al.
4,971,485 A 11/1990 Nomura et al.
4,991,670 A 2/1991 Fuller et al.
5,000,273 A 3/1991 Horton et al.
5,010,945 A 4/1991 Burke
5,030,598 A 7/1991 Hsieh
5,032,352 A 7/1991 Meeks et al.
5,041,261 A 8/1991 Buljan et al.
5,049,450 A 9/1991 Dorfman et al.
RE33,753 E 11/1991 Vacchiano et al.
5,067,860 A 11/1991 Kobayashi et al.
5,075,315 A 12/1991 Rasmussen
5,075,316 A 12/1991 Hubele
5,080,538 A 1/1992 Schmitt
5,090,491 A 2/1992 Tibbitts et al.
5,092,412 A 3/1992 Walk
5,094,571 A 3/1992 Ekerot
5,096,465 A 3/1992 Chen et al.
5,098,232 A 3/1992 Benson
5,110,687 A 5/1992 Abe et al.
5,112,162 A 5/1992 Hartford et al.
5,112,168 A 5/1992 Glimpel
5,116,659 A 5/1992 Glatzle et al.
5,126,206 A 6/1992 Garg et al.
5,127,776 A 7/1992 Glimpel
5,135,801 A 8/1992 Nyström et al.
5,161,898 A 11/1992 Drake
5,174,700 A 12/1992 Sgarbi et al.
5,179,772 A 1/1993 Braun et al.
5,186,739 A 2/1993 Isobe et al.
5,203,513 A 4/1993 Keller et al.
5,203,932 A 4/1993 Kato et al.
5,217,081 A 6/1993 Waldenström et al.

(56) References Cited

U.S. PATENT DOCUMENTS 5,232,522 A 8/1993 Doktycz et al.
5,250,355 A 10/1993 Newman et al.
5,266,415 A 11/1993 Newkirk et al.
5,273,380 A 12/1993 Musacchia
5,281,260 A 1/1994 Kumar et al.
5,286,685 A 2/1994 Schoennahl et al.
5,305,840 A 4/1994 Liang et al.
5,311,958 A 5/1994 Isbell et al.
5,326,196 A 7/1994 Noll
5,333,520 A 8/1994 Fischer et al.
5,335,738 A 8/1994 Waldenström et al.
5,338,135 A 8/1994 Noguchi et al.
5,346,316 A 9/1994 Okada et al.
5,348,806 A 9/1994 Kojo et al.
5,354,155 A 10/1994 Adams
5,359,772 A 11/1994 Carlsson et al.
5,373,907 A 12/1994 Weaver
5,376,329 A 12/1994 Morgan et al.
5,403,790 A * 4/1995 Claar et al. ..... 501/87
5,413,438 A 5/1995 Turchan
5,423,899 A 6/1995 Krall et al.
5,429,459 A 7/1995 Palm
5,433,280 A 7/1995 Smith
5,438,108 A 8/1995 Umemura et al.
5,438,858 A 8/1995 Friedrichs
5,443,337 A 8/1995 Katayama
5,447,549 A 9/1995 Yoshimura
5,452,771 A 9/1995 Blackman et al.
5,467,669 A 11/1995 Stroud
5,474,407 A 12/1995 Rodel et al.
5,479,997 A 1/1996 Scott et al.
5,480,272 A 1/1996 Jorgensen et al.
5,482,670 A 1/1996 Hong
5,484,468 A 1/1996 Östlund et al.
5,487,626 A 1/1996 Von Holst et al.
5,492,186 A 2/1996 Overstreet et al.
5,496,137 A 3/1996 Ochayon et al.
5,498,142 A 3/1996 Mills
5,505,248 A * 4/1996 Aghajanian et al. ..... 164/97
5,505,748 A 4/1996 Tank et al.
5,506,055 A 4/1996 Dorfman et al.
5,518,077 A 5/1996 Blackman et al.
5,525,134 A 6/1996 Mehrotra et al.
5,541,006 A 7/1996 Conley
5,543,235 A 8/1996 Mirchandani et al.
5,544,550 A 8/1996 Smith
5,560,238 A 10/1996 Allebach et al.
5,560,440 A 10/1996 Tibbitts
5,570,978 A 11/1996 Rees et al.
5,580,666 A 12/1996 Dubensky et al.
5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,286 A 3/1997 Anthon
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.
5,635,247 A 6/1997 Ruppi
5,641,251 A 6/1997 Leins et al.
5,641,921 A 6/1997 Dennis et al.
5,662,183 A 9/1997 Fang
5,665,431 A 9/1997 Narasimhan
5,666,864 A 9/1997 Tibbitts
5,672,382 A 9/1997 Lux
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,704,736 A 1/1998 Giannetti
5,712,030 A 1/1998 Goto et al.
5,718,948 A 2/1998 Ederyd et al.
5,732,783 A 3/1998 Truax et al.
5,733,078 A 3/1998 Matsushita et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Gunter et al.
5,755,298 A 5/1998 Langford, Jr. et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,791,833 A 8/1998 Niebauer
5,792,403 A 8/1998 Massa et al.
5,803,152 A 9/1998 Dolman et al.
5,806,934 A 9/1998 Massa et al.
5,830,256 A 11/1998 Northrop et al.
5,851,094 A 12/1998 Strand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A 3/1999 Fang et al.
5,890,852 A 4/1999 Gress
5,893,204 A 4/1999 Symonds
5,897,830 A 4/1999 Abkowitz et al.
5,899,257 A 5/1999 Alleweireldt et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
6,007,909 A 12/1999 Rolander et al.
6,012,882 A 1/2000 Turchan
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,076,999 A 6/2000 Hedberg et al.
6,086,003 A 7/2000 Gunter et al.
6,086,980 A 7/2000 Foster et al.
6,089,123 A 7/2000 Chow et al.
6,109,377 A 8/2000 Massa et al.
6,109,677 A 8/2000 Anthony
6,117,493 A 9/2000 North
6,135,218 A 10/2000 Deane et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,247 B1 4/2001 Leverenz et al.
6,214,287 B1 4/2001 Waldenström
6,217,992 B1 4/2001 Grab
6,220,117 B1 4/2001 Butcher
6,227,188 B1 5/2001 Tankala et al.
6,228,134 B1 5/2001 Erickson
6,228,139 B1 5/2001 Oskarsson
6,234,261 B1 5/2001 Evans et al.
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,302,224 B1 10/2001 Sherwood, Jr.
6,326,582 B1 12/2001 North
6,345,941 B1 2/2002 Fang et al.
6,353,771 B1 3/2002 Southland
6,372,346 B1 4/2002 Toth
6,374,932 B1 4/2002 Brady

(56) References Cited

U.S. PATENT DOCUMENTS 6,375,706 B2 4/2002 Kembaiyan et al.
6,386,954 B2 5/2002 Sawabe et al.
6,394,711 B1 5/2002 Brosius
6,395,108 B2 5/2002 Eberle et al.
6,402,439 B1 6/2002 Puide et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,475,647 B1 11/2002 Mendez Acevedo et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 1/2003 Mirchandani et al.
6,541,124 B1 4/2003 Suggs
6,544,308 B2 4/2003 Griffin et al.
6,546,991 B2 4/2003 Dworog et al.
6,551,035 B1 4/2003 Bruhn et al.
6,554,548 B1 4/2003 Grab et al.
6,562,462 B2 5/2003 Griffin et al.
6,576,182 B1 6/2003 Ravagni et al.
6,582,126 B2 6/2003 North
6,585,064 B2 7/2003 Griffin et al.
6,585,864 B1 7/2003 Fisher et al.
6,589,640 B2 7/2003 Griffin et al.
6,599,467 B1 7/2003 Yamaguchi et al.
6,607,693 B1 8/2003 Saito et al.
6,607,835 B2 8/2003 Fang et al.
6,620,375 B1 9/2003 Tank et al.
6,637,528 B2 10/2003 Nishiyama et al.
6,638,609 B2 10/2003 Nordgren et al.
6,648,068 B2 11/2003 Dewey et al.
6,649,682 B1 * 11/2003 Breton et al. ..... 524/404
6,651,757 B2 11/2003 Belnap et al.
6,655,481 B2 12/2003 Findley et al.
6,655,882 B2 12/2003 Heinrich et al.
6,676,863 B2 1/2004 Christiaens et al.
6,682,780 B2 1/2004 Tzatzov et al.
6,685,880 B2 2/2004 Engström et al.
6,688,988 B2 2/2004 McClure
6,695,551 B2 2/2004 Silver
6,706,327 B2 3/2004 Blomstedt et al.
6,716,388 B2 4/2004 Bruhn et al.
6,719,074 B2 4/2004 Tsuda et al.
6,723,389 B2 4/2004 Kobayashi et al.
6,725,953 B2 4/2004 Truax et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,767,505 B2 7/2004 Witherspoon et al.
6,772,849 B2 8/2004 Oldham et al.
6,782,958 B2 8/2004 Liang et al.
6,799,648 B2 10/2004 Brandenberg et al.
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,884,496 B2 4/2005 Westphal et al.
6,884,497 B2 4/2005 Sulin et al.
6,892,793 B2 5/2005 Liu et al.
6,899,495 B2 5/2005 Hansson et al.
6,918,942 B2 7/2005 Hatta et al.
6,932,172 B2 8/2005 Dvorachek
6,933,049 B2 8/2005 Wan et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,017,677 B2 3/2006 Keshavan et al.
7,036,611 B2 5/2006 Radford et al.
7,044,243 B2 5/2006 Kembaiyan et al.
7,048,081 B2 5/2006 Smith et al.
7,070,666 B2 7/2006 Druschitz et al.
7,080,998 B2 7/2006 Hall et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Craig et al.
7,128,773 B2 10/2006 Liang et al.
7,147,413 B2 12/2006 Henderer et al.
7,152,701 B2 12/2006 Butland et al.
7,172,142 B2 2/2007 Taylor et al.
7,175,404 B2 2/2007 Kondo et al.
7,192,660 B2 3/2007 Ruppi
7,204,117 B2 4/2007 Friedrichs
7,207,401 B2 4/2007 Dewey et al.
7,207,750 B2 4/2007 Annanolli et al.
7,216,727 B2 5/2007 Wardley
7,231,984 B2 6/2007 Jaensch
7,234,541 B2 6/2007 Scott et al.
7,234,550 B2 6/2007 Azar et al.
7,235,211 B2 6/2007 Griffo et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,262,240 B1 8/2007 Breton et al.
7,267,187 B2 9/2007 Kembaiyan
7,267,543 B2 9/2007 Freidhoff et al.
7,270,679 B2 9/2007 Istephanous et al.
7,296,497 B2 11/2007 Kugelberg et al.
7,350,599 B2 4/2008 Lockwood et al.
7,381,283 B2 6/2008 Lee et al.
7,384,413 B2 6/2008 Gross et al.
7,384,443 B2 6/2008 Mirchandani et al.
7,395,882 B2 7/2008 Oldham et al.
7,410,610 B2 8/2008 Woodfield et al.
7,487,849 B2 2/2009 Radtke
7,494,507 B2 2/2009 Dixon
7,497,280 B2 3/2009 Brackin et al.
7,497,396 B2 3/2009 Splinter et al.
7,513,320 B2 4/2009 Mirchandani et al.
7,524,351 B2 4/2009 Hua et al.
7,556,668 B2 7/2009 Eason et al.
7,575,620 B2 8/2009 Terry et al.
7,625,157 B2 12/2009 Prichard et al.
7,661,491 B2 2/2010 Kembaiyan et al.
7,687,156 B2 3/2010 Fang
7,703,555 B2 4/2010 Overstreet
7,832,456 B2 11/2010 Calnan et al.
7,832,457 B2 11/2010 Calnan et al.
7,846,551 B2 12/2010 Fang et al.
7,887,747 B2 2/2011 Iwasaki et al.
7,954,569 B2 6/2011 Mirchandani et al.
8,007,714 B2 8/2011 Mirchandani et al.
8,007,922 B2 8/2011 Mirchandani et al.
8,025,112 B2 9/2011 Mirchandani et al.
8,087,324 B2 1/2012 Mirchandani et al.
8,109,177 B2 2/2012 Kembaiyan et al.
8,137,816 B2 3/2012 Fang et al.
8,141,665 B2 3/2012 Ganz
8,221,517 B2 7/2012 Mirchandani et al.
8,225,886 B2 7/2012 Mirchandani et al.
8,272,816 B2 9/2012 Mirchandani
8,308,096 B2 11/2012 Mirchandani et al.
8,312,941 B2 11/2012 Mirchandani et al.
8,318,063 B2 11/2012 Mirchandani et al.
8,322,465 B2 12/2012 Mirchandani
2002/0004105 A1 1/2002 Kunze et al.
2003/0010409 A1 1/2003 Kunze et al.
2003/0041922 A1 3/2003 Hirose et al.
2003/0219605 A1 11/2003 Molian et al.

(56) References Cited

U.S. PATENT DOCUMENTS

| | | | | |
|---|---|---|---|---|
| 2004/0013558 | A1 | 1/2004 | Kondoh et al. | |
| 2004/0105730 | A1 | 6/2004 | Nakajima | |
| 2004/0219050 | A1* | 11/2004 | Hailey | 419/28 |
| 2004/0228695 | A1 | 11/2004 | Clauson | |
| 2004/0234820 | A1 | 11/2004 | Majagi | |
| 2004/0244540 | A1 | 12/2004 | Oldham et al. | |
| 2004/0245022 | A1 | 12/2004 | Izaguirre et al. | |
| 2004/0245024 | A1 | 12/2004 | Kembaiyan | |
| 2005/0008524 | A1 | 1/2005 | Testani | |
| 2005/0019114 | A1 | 1/2005 | Sung | |
| 2005/0084407 | A1 | 4/2005 | Myrick | |
| 2005/0103404 | A1 | 5/2005 | Hsieh et al. | |
| 2005/0117984 | A1 | 6/2005 | Eason et al. | |
| 2005/0194073 | A1 | 9/2005 | Hamano et al. | |
| 2005/0211475 | A1 | 9/2005 | Mirchandani et al. | |
| 2005/0247491 | A1* | 11/2005 | Mirchandani et al. | 175/374 |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0060392 | A1 | 3/2006 | Eyre | |
| 2006/0185773 | A1 | 8/2006 | Chiovelli | |
| 2006/0286410 | A1 | 12/2006 | Ahigren et al. | |
| 2006/0288820 | A1 | 12/2006 | Mirchandani et al. | |
| 2007/0082229 | A1 | 4/2007 | Mirchandani et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0126334 | A1 | 6/2007 | Nakamura et al. | |
| 2007/0154738 | A1 | 7/2007 | Ganguly et al. | |
| 2007/0163679 | A1 | 7/2007 | Fujisawa et al. | |
| 2007/0193782 | A1 | 8/2007 | Fang et al. | |
| 2008/0011519 | A1 | 1/2008 | Smith et al. | |
| 2008/0101977 | A1 | 5/2008 | Eason et al. | |
| 2008/0196318 | A1 | 8/2008 | Bost et al. | |
| 2008/0202821 | A1* | 8/2008 | McClain et al. | 175/434 |
| 2008/0302576 | A1 | 12/2008 | Mirchandani et al. | |
| 2009/0032501 | A1 | 2/2009 | Swingley et al. | |
| 2009/0041612 | A1 | 2/2009 | Fang et al. | |
| 2009/0136308 | A1 | 5/2009 | Newitt | |
| 2009/0180915 | A1 | 7/2009 | Mirchandani et al. | |
| 2009/0301788 | A1 | 12/2009 | Stevens et al. | |
| 2010/0044114 | A1 | 2/2010 | Mirchandani et al. | |
| 2010/0278603 | A1 | 11/2010 | Fang et al. | |
| 2010/0323213 | A1 | 12/2010 | Aitchison et al. | |
| 2011/0107811 | A1 | 5/2011 | Mirchandani et al. | |
| 2011/0265623 | A1 | 11/2011 | Mirchandani et al. | |
| 2011/0284179 | A1 | 11/2011 | Stevens et al. | |
| 2011/0287238 | A1 | 11/2011 | Stevens et al. | |
| 2011/0287924 | A1 | 11/2011 | Stevens | |
| 2012/0237386 | A1 | 9/2012 | Mirchandani et al. | |
| 2012/0240476 | A1 | 9/2012 | Mirchandani et al. | |
| 2012/0241222 | A1 | 9/2012 | Mirchandani et al. | |
| 2012/0282051 | A1 | 11/2012 | Mirchandani | |
| 2012/0285293 | A1 | 11/2012 | Mirchandani et al. | |
| 2012/0321498 | A1 | 12/2012 | Mirchandani | |
| 2013/0025127 | A1 | 1/2013 | Mirchandani et al. | |
| 2013/0025813 | A1 | 1/2013 | Mirchandani et al. | |
| 2013/0026274 | A1 | 1/2013 | Mirchandani et al. | |
| 2013/0028672 | A1 | 1/2013 | Mirchandani et al. | |
| 2013/0036872 | A1 | 2/2013 | Mirchandani et al. | |
| 2013/0037985 | A1 | 2/2013 | Mirchandani | |
| 2013/0043615 | A1 | 2/2013 | Mirchandani et al. | |
| 2013/0075165 | A1 | 3/2013 | Coleman et al. | |

FOREIGN PATENT DOCUMENTS

| | | | |
|---|---|---|---|
| CA | 1158073 | A | 12/1983 |
| CA | 1250156 | A | 2/1989 |
| CA | 2022065 | A1 | 2/1991 |
| CA | 2120332 | | 6/1993 |
| CA | 2107004 | C | 5/1996 |
| CA | 2228398 | A1 | 2/1997 |
| CA | 2198985 | A1 | 9/1998 |
| CA | 2108274 | C | 7/2000 |
| CA | 2212197 | C | 10/2000 |
| CA | 2201969 | C | 2/2003 |
| CA | 2213169 | C | 3/2005 |
| CA | 2498073 | A1 | 8/2006 |
| CA | 2556132 | A1 | 2/2007 |
| CA | 2570937 | A1 | 6/2007 |
| CA | 2357407 | C | 1/2008 |
| DE | 19634314 | A1 | 1/1998 |
| DE | 10300283 | B3 | 6/2004 |
| DE | 102006030661 | A1 | 1/2008 |
| DE | 102007006943 | A1 | 8/2008 |
| EP | 0157625 | A2 | 10/1985 |
| EP | 0264674 | A2 | 4/1988 |
| EP | 0453428 | A1 | 10/1991 |
| EP | 0605585 | B1 | 8/1995 |
| EP | 0641620 | B1 | 2/1998 |
| EP | 0995876 | A2 | 4/2000 |
| EP | 1065021 | A1 | 1/2001 |
| EP | 1066901 | A2 | 1/2001 |
| EP | 1106706 | A1 | 6/2001 |
| EP | 0759480 | B1 | 1/2002 |
| EP | 1077268 | B1 | 5/2003 |
| EP | 1244531 | B1 | 10/2004 |
| EP | 1686193 | A2 | 8/2006 |
| EP | 1788104 | A1 | 5/2007 |
| FR | 2627541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2064619 | A | 6/1981 |
| GB | 2158744 | A | 11/1985 |
| GB | 2218931 | A | 11/1989 |
| GB | 2315452 | A | 2/1998 |
| GB | 2324752 | A | 11/1998 |
| GB | 2352727 | A | 2/2001 |
| GB | 2384745 | A | 8/2003 |
| GB | 2385350 | A | 8/2003 |
| GB | 2393449 | A | 3/2004 |
| GB | 2397832 | A | 8/2004 |
| GB | 2409467 | A | 6/2005 |
| GB | 2435476 | A | 8/2007 |
| JP | 51-124876 | A | 10/1976 |
| JP | 56-52604 | U | 5/1981 |
| JP | 59-54510 | A | 3/1984 |
| JP | 59-56501 | A | 4/1984 |
| JP | 59-67333 | A | 4/1984 |
| JP | 59-169707 | A | 9/1984 |
| JP | 59-175912 | A | 10/1984 |
| JP | 60-48207 | A | 3/1985 |
| JP | 60-172403 | A | 9/1985 |
| JP | 60-224790 | A | 11/1985 |
| JP | 61-226231 | A | 10/1986 |
| JP | 61-243103 | A | 10/1986 |
| JP | 61057123 | B | 12/1986 |
| JP | 62-34710 | A | 2/1987 |
| JP | 62-063005 | A | 3/1987 |
| JP | 62-218010 | A | 9/1987 |
| JP | 62-278250 | A | 12/1987 |
| JP | 1-171725 | A | 7/1989 |
| JP | 2-95506 | A | 4/1990 |
| JP | 2-269515 | A | 11/1990 |
| JP | 3-43112 | A | 2/1991 |
| JP | 3-73210 | A | 3/1991 |
| JP | 5-50314 | A | 3/1993 |
| JP | 5-92329 | A | 4/1993 |
| JP | H05-64288 | U | 8/1993 |
| JP | H03-119090 | U | 6/1995 |
| JP | 7-276105 | A | 10/1995 |
| JP | 8-120308 | A | 5/1996 |
| JP | H8-209284 | | 8/1996 |
| JP | 8-294805 | A | 11/1996 |
| JP | 9-11005 | A | 1/1997 |
| JP | 9-192930 | A | 7/1997 |
| JP | 9-253779 | A | 9/1997 |

(56) References Cited

FOREIGN PATENT DOCUMENTS

| | | | |
|---|---|---|---|
| JP | 10-138033 | A | 5/1998 |
| JP | 10219385 | A | 8/1998 |
| JP | H10-511740 | A | 11/1998 |
| JP | 11-10409 | A | 1/1999 |
| JP | 11-300516 | A | 11/1999 |
| JP | 2000-237910 | A | 9/2000 |
| JP | 2000-296403 | A | 10/2000 |
| JP | 2000-355725 | A | 12/2000 |
| JP | 2002-097885 | A | 4/2002 |
| JP | 2002-166326 | A | 6/2002 |
| JP | 2002-317596 | A | 10/2002 |
| JP | 2003-306739 | A | 10/2003 |
| JP | 2004-160591 | A | 6/2004 |
| JP | 2004-181604 | | 7/2004 |
| JP | 2004-190034 | A | 7/2004 |
| JP | 2005-111581 | A | 4/2005 |
| KR | 20050055268 | | 6/2005 |
| RU | 2135328 | C1 | 8/1999 |
| RU | 2173241 | C2 | 2/2000 |
| RU | 2167262 | C2 | 5/2001 |
| SU | 967786 | A1 | 10/1982 |
| SU | 975369 | A1 | 11/1982 |
| SU | 990423 | A1 | 1/1983 |
| SU | 1269922 | A | 11/1986 |
| SU | 1292917 | A1 | 2/1987 |
| SU | 1350322 | | 11/1987 |
| UA | 6742 | | 12/1994 |
| UA | 63469 | C2 | 1/2006 |
| UA | 23749 | U | 6/2007 |
| WO | WO 92/05009 | A1 | 4/1992 |
| WO | WO 92/22390 | A1 | 12/1992 |
| WO | WO 97/00734 | A1 | 1/1997 |
| WO | WO 97/19201 | A1 | 5/1997 |
| WO | WO 97/34726 | A1 | 9/1997 |
| WO | WO 98/28455 | A1 | 7/1998 |
| WO | WO 99/13121 | A1 | 3/1999 |
| WO | WO 99/36590 | A1 | 7/1999 |
| WO | WO 00/43628 | A2 | 7/2000 |
| WO | WO 00/52217 | A1 | 9/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |
| WO | WO 2008/115703 | A1 | 9/2008 |
| WO | WO 2011/000348 | A1 | 1/2011 |
| WO | WO 2011/008439 | A2 | 1/2011 |

OTHER PUBLICATIONS

Specialty Metals, "Tungchip Dispenser, An improved feeder design, to allow for accurate delivery of Tungsten Carbide granules into the molten weld pool, generated by a MIG (GMAW) welding system", (undated) 2 pages.

Dynalloy Industries, G.M.A.C.E, 2003, printed Jul. 8, 2009, 1 page.

Alloys International (Australasia) Pty. Ltd., "The Tungsten Carbide Vibratory Feeder System", (undated) 6 pages.

Dynalloy Industries, Hardhead Technology, Tungsten Carbide Pellets, 2003, printed Jul. 8, 2009, 1 page.

Lincoln Electric, MIG Carbide Vibratory Feeder Assembly, (undated) 1 page.

Wearshield Hardfacing Electrodes, Tungsten Carbide Products, (undated) 1 page.

Postalloy, The best in hardfacing, Postle Industries, Inc., (undated) 13 pages.

Postalloy, Postle Industries, Inc., Postalloy PS-98, Tungsten Matrix Alloy, (undated) 1 page.

Postalloy, Data Sheet, Postle Industries, Inc., Postalloy 299-SPL, (undated) 1 page.

Postalloy, Data Sheet, Postle Industries, Inc., Postalloy CP 63070, (undated) 1 page.

Postalloy, Data Sheet, Postle Industries, Inc., Postalloy 14 TC, (undated) 1 page.

Postalloy, Data Sheet, Postle Industries, Inc., Postalloy PS-98, A Tungsten Carbide Matrix Wire for Carbide Embedding, (undated) 1 page.

Industrial Renewal Services, Steel BOC (Basic Oxygen Furnace) & BOP (Basic Oxygen Process) Hoods, printed Nov. 8, 2007, 2 pages.

UWO Products, printed Nov. 8, 2007 from http://www.universalweld.com/products.htm, 2 pages.

US 4,966,627, 10/1990, Keshavan et al. (withdrawn).

Office Action mailed Feb. 27, 2013 in U.S. Appl. No. 13/550,690.

Office Action mailed Jan. 23, 2013 in U.S. Appl. No. 13/652,508.

Office Action mailed Apr. 5, 2013 in U.S. Appl. No. 13/632,177.

Restriction Requirement mailed Jan. 3, 2013 in U.S. Appl. No. 13/632,178.

Office Action mailed Mar. 6, 2013 in U.S. Appl. No. 13/632,178.

Office Action mailed Oct. 4, 2012 in U.S. Appl. No. 13/491,638.

Notice of Allowance mailed Mar. 6, 2013 in U.S. Appl. No. 13/491,638.

Restriction Requirement mailed Jul. 24, 2008 in U.S. Appl. No. 11/167,811.

Office Action mailed Oct. 21, 2008 in U.S. Appl. No. 11/167,811.

Final Office Action mailed Jun. 12, 2009 in U.S. Appl. No. 11/167,811.

Office Action mailed Aug. 28, 2009 in U.S. Appl. No. 11/167,811.

Office Action mailed Mar. 2, 2010 in U.S. Appl. No. 11/167,811.

Office Action mailed Aug. 19, 2010 in U.S. Appl. No. 11/167,811.

Advisory Action Before the Filing of an Appeal Brief mailed May 12, 2010 in U.S. Appl. No. 11/167,811.

Office Action mailed Feb. 3, 2011 in U.S. Appl. No. 11/167,811.

Advisory Action mailed May 11, 2011 in U.S. Appl. No. 11/167,811.

Office Action mailed Jul. 22, 2011 in U.S. Appl. No. 11/167,811.

Office Action mailed Mar. 28, 2012 in U.S. Appl. No. 11/167,811.

Restriction Requirement mailed Sep. 17, 2010 in U.S. Appl. No. 12/397,597.

Office Action mailed Nov. 15, 2010 in U.S. Appl. No. 12/397,597.

Office Action mailed Jun. 7, 2011 in U.S. Appl. No. 12/397,597.

Advisory Action Before the Filing of an Appeal Brief mailed Aug. 31, 2011 in U.S. Appl. No. 12/397,597.

Office Action mailed Nov. 17, 2011 in U.S. Appl. No. 12/397,597.

Advisory Action mailed Jan. 26, 2012 in U.S. Appl. No. 12/397,597.

Office Action mailed Apr. 13, 2012 in U.S. Appl. No. 12/397,597.

Office Action mailed Dec. 29, 2005 in U.S. Appl. No. 10/903,198.

Office Action mailed Sep. 29, 2006 in U.S. Appl. No. 10/903,198.

Office Action mailed Mar. 27, 2007 in U.S. Appl. No. 10/903,198.

Office Action mailed Sep. 26, 2007 in U.S. Appl. No. 10/903,198.

Office Action mailed Jan. 16, 2008 in U.S. Appl. No. 10/903,198.

Office Action mailed Oct. 31, 2008 in U.S. Appl. No. 10/903,198.

Office Action mailed Apr. 17, 2009 in U.S. Appl. No. 10/903,198.

Advisory Action before mailing of Appeal Brief mailed Jun. 29, 2009 in U.S. Appl. No. 10/903,198.

Examiner's Answer mailed Aug. 17, 2010 in U.S. Appl. No. 10/903,198.

Office Action mailed Oct. 13, 2011 in U.S. Appl. No. 12/179,999.

Notice of Allowance mailed Apr. 30, 2012 in U.S. Appl. No. 12/179,999.

Office Action mailed Aug. 29, 2011 in U.S. Appl. No. 12/476,738.

Office Action mailed Dec. 21, 2011 in U.S. Appl. No. 12/476,738.

Notice of Allowance mailed Apr. 17, 2012 in U.S. Appl. No. 12/476,738.

Corrected Notice of Allowability mailed Jun. 21, 2012 in U.S. Appl. No. 12/476,738.

Office Action mailed Dec. 5, 2011 in U.S. Appl. No. 13/182,474.

(56) References Cited

OTHER PUBLICATIONS

Office Action mailed Apr. 27, 2012 in U.S. Appl. No. 13/182,474.
Notice of Allowance mailed Jul. 18, 2012 in U.S. Appl. No. 13/182,474.
Notification of Reopening of Prosecution Due to Consideration of an Information Disclosure Statement Filed After Mailing of a Notice of Allowance mailed Oct. 10, 2012 in U.S. Appl. No. 13/182,474.
Office Action mailed Jun. 1, 2001 in U.S. Appl. No. 09/460,540.
Office Action mailed Dec. 1, 2001 in U.S. Appl. No. 09/460,540.
Office Action mailed Mar. 15, 2002 in U.S. Appl. No. 09/460,540.
Office Action mailed Jun. 18, 2002 in U.S. Appl. No. 09/460,540.
Notice of Allowance mailed Oct. 21, 2002 in U.S. Appl. No. 09/460,540.
Office Action mailed Jan. 16, 2007 in U.S. Appl. No. 11/013,842.
Office Action mailed Jul. 16, 2008 in U.S. Appl. No. 11/013,842.
Office Action mailed Jul. 30, 2007 in U.S. Appl. No. 11/013,842.
Notice of Allowance mailed Nov. 26, 2008 in U.S. Appl. No. 11/013,842.
Office Action mailed Oct. 13, 2006 in U.S. Appl. No. 10/922,750.
Notice of Allowance mailed May 21, 2007 for U.S. Appl. No. 10/922,750.
Supplemental Notice of Allowability mailed Jul. 3, 2007 for U.S. Appl. No. 10/922,750.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Restriction Requirement mailed Aug. 4, 2010 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Office Action mailed Aug. 31, 2007 in U.S. Appl. No. 11/206,368.
Office Action mailed Feb. 28, 2008 in U.S. Appl. No. 11/206,368.
Pre-Appeal Conference Decision mailed Jun. 19, 2008 in U.S. Appl. No. 11/206,368.
Notice of Allowance mailed Nov. 13, 2008 in U.S. Appl. No. 11/206,368.
Office Action mailed Apr. 30, 2009 in U.S. Appl. No. 11/206,368.
Notice of Allowance mailed Nov. 30, 2009 in U.S. Appl. No. 11/206,368.
Office Action mailed Sep. 2, 2011 in U.S. Appl. No. 12/850,003.
Notice of Allowance mailed Nov. 15, 2011 in U.S. Appl. No. 12/850,003.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No. 11/924,273.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.
Office Action mailed Mar. 15, 2012 in U.S. Appl. No. 12/464,607.
Notice of Allowance mailed Apr. 9, 2012 in U.S. Appl. No. 12/464,607.
Notice of Allowance mailed Jul. 16, 2012 in U.S. Appl. No. 12/464,607.
Office Action mailed Oct. 31, 2011 in U.S. Appl. No. 13/207,478.
Office Action mailed Mar. 2, 2012 in U.S. Appl. No. 13/207,478.
Notice of Allowance mailed Apr. 13, 2012 in U.S. Appl. No. 13/207,478.
Supplemental Notice of Allowability mailed Jun. 29, 2012 in U.S. Appl. No. 13/207,478.
Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Notice of Allowance mailed May 9, 2012 in U.S. Appl. No. 11/585,408.
Notice of Allowance mailed Jul. 20, 2012 in U.S. Appl. No. 11/585,408.
Corrected Notice of Allowability mailed Oct. 18, 2012 in U.S. Appl. No. 11/585,408.
Office Action mailed Mar. 19, 2009 in U.S. Appl. No. 11/737,993.
Office Action mailed Jun. 3, 2009 in U.S. Appl. No. 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Office Action mailed Oct. 11, 2011 in U.S. Appl. No. 11/737,993.
Office Action mailed Jan. 6, 2012 in U.S. Appl. No. 11/737,993.
Advisory Action Before the Filing of an Appeal Brief mailed Mar. 22, 2012 in U.S. Appl. No. 11/737,993.
Notice of Allowance mailed Jul. 25, 2012 in U.S. Appl. No. 11/737,993.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Office Action mailed Oct. 19, 2011 in U.S. Appl. No. 12/196,951.
Office Action mailed Mar. 19, 2012 in U.S. Appl. No. 12/196,951.
Notice of Allowance mailed Jul. 31, 2012 in U.S. Appl. No. 12/196,951.
Office Action mailed Nov. 14, 2011 in U.S. Appl. No. 12/502,277.
Office Action mailed Jan. 20, 2012 in U.S. Appl. No. 12/502,277.
Notice of Allowance mailed Jul. 10, 2012 in U.S. Appl. No. 12/502,277.
Supplemental Notice of Allowability mailed Jul. 20, 2012 in U.S. Appl. No. 12/502,277.
Office Action mailed Feb. 5, 2013 in U.S. Appl. No. 13/652,503.
Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.
Deng, X. et al., "Mechanical Properties of a Hybrid Cemented Carbide Composite," International Journal of Refractory Metals and Hard Materials, Elsevier Science Ltd., vol. 19, 2001, pp. 547-552.
Gurland, Joseph, "Application of Quantitative Microscopy to Cemented Carbides," Practical Applications of Quantitative Matellography, ASTM Special Technical Publication 839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Metals Handbook, vol. 16 Machining, "Cemented Carbides" (ASM International 1989), pp. 71-89.
Metals Handbook, vol. 16 Machining, "Tapping" (ASM International 1989), pp. 255-267.
Peterman, Walter, "Heat-Sink Compound Protects the Unprotected," Welding Design and Fabrication, Sep. 2003, pp. 20-22.
Shi et al., "Composite Ductility—The Role of Reinforcement and Matrix", TMS Meeting, Las Vegas, NV, Feb. 12-16, 1995, 10 pages.
Sriram, et al., "Effect of Cerium Addition on Microstructures of Carbon-Alloyed Iron Aluminides," Bull. Mater. Sci., vol. 28, No. 6, Oct. 2005, pp. 547-554.
Tracey et al., "Development of Tungsten Carbide—Cobalt—Ruthenium Cutting Tools for Machining Steels" Proceedings Annual Microprogramming Workshop, vol. 14, 1981, pp. 281-292.
Vander Vort, "Introduction to Quantitative Metallography", Tech Notes, vol. 1, Issue 5, published by Buehler, Ltd. 1997, 6 pages.
J. Gurland, *Quantitative Microscopy*, R.T. DeHoff and F.N. Rhines, eds., McGraw-Hill Book Company, New York, 1968, pp. 279-290.

(56) References Cited

OTHER PUBLICATIONS

You Tube, "The Story Behind Kennametal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
ASM Materials Engineering Dictionary, J.R. Davis, Ed., ASM International, Fifth printing, Jan. 2006, p. 98.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies, attached to Declaration of Prakash Mirchandani, Ph.D as filed in U.S. Appl. No. 11/737,993 on Sep. 9, 2009.
Metals Handbook Desk Edition, definition of 'wear', 2nd Ed., J.R. Davis, Editor, ASM International 1998, p. 62.
McGraw-Hill Dictionary of Scientific and Technical Terms, 5th Edition, Sybil P. Parker, Editor in Chief, 1994, pp. 799, 800, 1933, and 2047.
ProKon Version 8.6, The Calculation Companion, Properties for W, Ti, Mo, Co, Ni and Fe, Copyright 1997-1998, 6 pages.
Underwood, *Quantitative Stereology*, pp. 23-108 (1970).
Tibtech Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.
Williams, Wendell S., "The Thermal Conductivity of Metallic Ceramics", JOM, Jun. 1998, pp. 62-66.
Brookes, Kenneth J. A., "World Directory and Handbook of Hardmetals and Hard Materials", International Carbide Data, U.K. 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27, 2011, 3 pages.
The Thermal Conductivity of Some Common Materials and Gases, The Engineering ToolBox, printed from http://www.engineeringtoolbox.com/thermal-conductivity-d_429.html on Dec. 15, 2011, 4 pages.
ASTM G65-04, Standard Test Method for Measuring Abrasion Using the Dry Sand, Nov. 1, 2004, printed from http://infostore.saiglobal.com.
Tool and Manufacturing Engineers Handbook, Fourth Edition, vol. 1, Machining, Society of Manufacturing Engineers, Chapter 12, vol. 1, 1983, pp. 12-110-12-114.
Beard, T. "The INS and OUTS of Thread Milling; Emphasis: Hole Making, Interview", Modern Machine Shop, Gardner Publications, Inc. 1991, vol. 64, No. 1, 5 pages.
Koelsch, J., "Thread Milling Takes on Tapping", Manufacturing Engineering, 1995, vol. 115, No. 4, 6 pages.
Johnson, M. "Tapping, Traditional Machining Processes", 1997, pp. 255-265.
"Thread Milling", Traditional Machining Processes, 1997, pp. 268-269.
Scientific Cutting Tools, "The Cutting Edge", 1998, printed on Feb. 1, 2000, 15 pages.
Helical Carbide Thread Mills, Schmarje Tool Company, 1998, 2 pages.
Pyrotek, Zyp Zircwash, www.pyrotek.info, Feb. 2003, 1 page.
Sims et al., "Casting Engineering", Superalloys II, Aug. 1987, pp. 420-426.
Sikkenga, "Cobalt and Cobalt Alloy Castings", Casting, vol. 15, ASM Handbook, ASM International, 2008, pp. 1114-1118.
Starck, H.C., Surface Technology, Powders for PTA-Welding, Lasercladding and other Wear Protective Welding Applications, Jan. 2011, 4 pages.
Ancormet® 101, Data Sheet, 0001-AM101-D-1, Hoeganaes, www.hoeganaes.com, 7 pages. (date unavailable).
Shi et al., "Study on shaping technology of nanocrystalline WC—Co composite powder", Rare Metal and Materials and Engineering, vol. 33, Suppl. 1, Jun. 2004, pp. 93-96. (English abstract).
Notice of Allowance mailed Feb. 4, 2008 in U.S. Appl. No. 11/013,842.

* cited by examiner

METHODS OF FORMING WEAR RESISTANT LAYERS ON METALLIC SURFACES

BACKGROUND OF THE TECHNOLOGY

1. Field of Technology

This application generally relates to methods for forming wear resistant layers on surfaces of metallic articles of manufacture (i.e., substrates). The wear resistant layers may provide resistance to wear caused by abrasion, impact, erosion, corrosion, and/or heat.

2. Description of the Background of the Technology

Wear resistant materials may be applied as coatings to protect metallic substrates from degradation due to mechanical, chemical, and/or environmental conditions. For example, methods of coating or hardfacing metallic substrates may involve applying a hard, wear resistant material to a surface of the metallic substrate to reduce wear caused by abrasion, impact, erosion, corrosion, and/or heat. A variety of conventional methods may be utilized to apply wear resistant material to the surface of metallic substrates. In hardfacing, for example, a wear resistant layer may be welded onto the surface of a metallic substrate. In another method, a wear resistant layer is applied to the surface of the metallic substrate using a viscous paste, usually in the form of a flexible sheet or cloth, at an elevated temperature. Conventional wear resistant materials are commercially available from, for example, Kennametal Inc. (under the trade name CONFORMA CLAD), Innobraze GmbH (under the trade name BRAZECOAT), and Gremada Industries (under the trade name LASERCARB). The wear resistant materials may be applied to articles subjected to wear such as, for example, extruders, containers, gear boxes, bearings, compressors, pumps, pipes, tubing, molding dies, valves, reactor vessels, and components of mining and earth moving equipment.

Conventional methods for applying wear resistant material to surfaces of metallic substrates may suffer from one or more of the following limitations: conventional wear resistant materials may be difficult to apply to the internal surfaces and geometrically complex surfaces of certain metallic substrates using conventional application methods; conventional methods may limit the thickness and coverage area of the wear resistant layer; the possible composition of wear resistant materials may be limited because many conventional application methods require complete melting of the materials during application; and conventional application methods may be time consuming and expensive.

Therefore, it would be advantageous to provide improved methods for applying wear resistant materials to surfaces of metallic substrates.

SUMMARY

One non-limiting aspect according to the present disclosure is directed to a method of forming a wear resistant layer on a metallic substrate. The method may generally comprise positioning hard particles adjacent at least a region of a surface of the metallic substrate and infiltrating the hard particles with a metallic binder material to form the wear resistant layer metallurgically bonded to the surface of the metallic substrate. In certain non-limiting embodiments of the method, the infiltration temperature may be 50° C. to 100° C. greater than a liquidus temperature of the metallic binder material. In certain non-limiting embodiments of the method, the time of infiltration may be less than one (1) hour. In certain non-limiting embodiments of the method, the wear resistant layer may be formed on an exterior surface and/or an interior surface of the metallic substrate. In certain non-limiting embodiments of the method, the wear resistant layer may have a thickness from 1 mm to 100 mm. The wear resistant layer is not be formed by either of welding or hardfacing.

Another non-limiting aspect according to the present disclosure is directed to a wear resistant layer comprising hard particles infiltrated with a metallic binder material and metallurgically bonded to at least a region of a surface of a metallic substrate. In certain non-limiting embodiments, the metallic substrate may comprise one of a steel, nickel, a nickel alloy, titanium, a titanium alloy, aluminum, an aluminum alloy, copper, a copper alloy, cobalt, a cobalt alloy, and combinations thereof. In certain non-limiting embodiments, the metallic binder material may comprise at least one of copper, a copper alloy, aluminum, an aluminum alloy, iron, an iron alloy, nickel, a nickel alloy, cobalt, a cobalt alloy, titanium, a titanium alloy, magnesium, a magnesium alloy, a bronze, and a brass. In certain non-limiting embodiments, the hard particles may comprise at least one of carbide particles, nitride particles, boride particles, silicide particles, oxide particles, and particles comprising a solid solution of at least two of carbide, nitride, boride, silicide, and oxide. In certain non-limiting embodiments, the hard particles have a solidus temperature at least 50° C. greater than a liquidus temperature of the metallic binder material. In certain non-limiting embodiments, the wear resistant layer may comprise 10 to 90 volume percent of the hard particles.

A further non-limiting aspect according to the present disclosure is directed to an article of manufacture comprising a wear resistant layer according to the present disclosure disposed on at least a region of a surface of the article. In certain non-limiting embodiments, the article of manufacture may be one of a pipe, a tube, a valve, a valve part, a flange, a bearing, a drill bit, an earth boring bit, a die, a container, a part or a component used in earth moving equipment, or a radial bearing for mud motors used in oil/gas exploration. One particular non-limiting embodiment of an article of manufacture according to the present disclosure is a pipe for conducting abrasive and/or corrosive fluids, wherein a wear resistant layer according to the present disclosure is disposed on at least a region of an interior surface of the pipe that is contacted by the fluids being conducted through the pipe.

An additional non-limiting aspect according to the present disclosure is directed to a method of improving the resistance of at least a region of a metallic surface to at least one of abrasion, impact, erosion, corrosion, and heat by providing a wear resistant layer according to the present disclosure on the region of the metallic surface.

It is understood that the invention disclosed and described in this specification is not limited to the embodiments described in this Summary.

BRIEF DESCRIPTION OF THE DRAWINGS

The various non-limiting embodiments described herein may be better understood by considering the following description in conjunction with one or more of the accompanying drawings.

Figure 1:
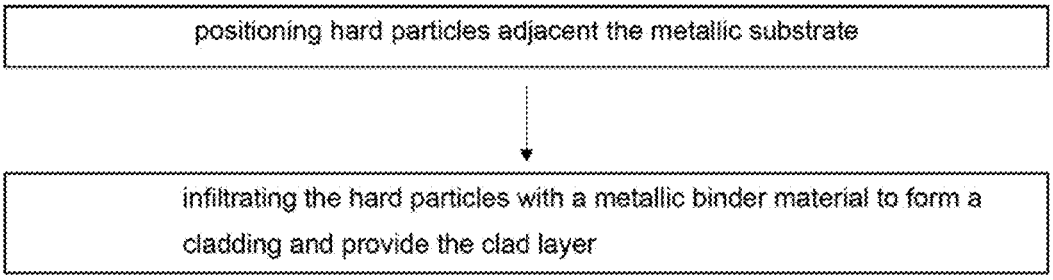
FIG. 1 is a flowchart illustrating a non-limiting embodiment of a method of forming a wear resistant layer according to the present disclosure.

The reader will appreciate the foregoing details, as well as others, upon considering the following description of various non-limiting and non-exhaustive embodiments according to the present disclosure.

DESCRIPTION

The present disclosure describes features, aspects, and advantages of various embodiments of methods for forming wear resistant layers. It is understood, however, that this disclosure also embraces numerous alternative embodiments that may be accomplished by combining any of the various features, aspects, and/or advantages of the various embodiments described herein in any combination or sub-combination that one of ordinary skill in the art may find useful. Such combinations or sub-combinations are intended to be included within the scope of this specification. As such, the claims may be amended to recite any features or aspects expressly or inherently described in, or otherwise expressly or inherently supported by, the present disclosure. Further, Applicants reserve the right to amend the claims to affirmatively disclaim any features or aspects that may be present in the prior art. Therefore, any such amendments comply with the requirements of 35 U.S.C. §112, first paragraph, and 35 U.S.C. §132(a). The various embodiments disclosed and described in this specification may comprise, consist of, or consist essentially of the features and aspects as variously described herein.

All numerical quantities stated herein are approximate, unless stated otherwise. Accordingly, the term "about" may be inferred when not expressly stated. The numerical quantities disclosed herein are to be understood as not being strictly limited to the exact numerical values recited. Instead, unless stated otherwise, each numerical value included in the present disclosure is intended to mean both the recited value and a functionally equivalent range surrounding that value. Notwithstanding the approximations of numerical quantities stated herein, the numerical quantities described in specific examples of actual measured values are reported as precisely as possible.

All numerical ranges stated herein include all sub-ranges subsumed therein. For example, a range of "1 to 10" is intended to include all sub-ranges between and including the recited minimum value of 1 and the recited maximum value of 10. Any maximum numerical limitation recited herein is intended to include all lower numerical limitations. Any minimum numerical limitation recited herein is intended to include all higher numerical limitations.

In the following description, certain details are set forth in order to provide a better understanding of various embodiments. However, one skilled in the art will understand that these embodiments may be practiced without these details. In other instances, well-known structures, methods, and/or techniques associated with methods of practicing the various embodiments may not be shown or described in detail to avoid unnecessarily obscuring descriptions of other details of the various embodiments.

As generally used herein, the articles "the", "a", and "an" refer to one or more of what is claimed or described.

As generally used herein, the terms "include", "includes", and "including" are meant to be non-limiting.

As generally used herein, the terms "have", "has", and "having" are meant to be non-limiting.

Referring to FIG. 1, in various non-limiting embodiments according to the present disclosure, a method for forming a wear resistant layer on at least a region of a surface of a metallic substrate generally comprises positioning hard particles adjacent the surface of the metallic substrate and infiltrating the hard particles with a metallic binder material to form a wear resistant layer metallurgically bonded to the surface of the metallic substrate. The wear resistant layer may protect all or a region of the surface of the metallic substrate from wear caused by one or more of abrasion, impact, erosion, corrosion, and heat. In various embodiments, a method of improving the resistance of a metallic surface to at least one of abrasion, impact, erosion, corrosion, and heat may generally comprise providing the wear resistant layer on at least a region of a surface of the metallic substrate.

Certain embodiments of methods of providing wear resistant layers described herein may have advantages over conventional approaches. Such advantages may include, but are not limited to, the ability to provide wear resistant layers: on internal surfaces and surfaces having complex geometries; having greater thicknesses and covering larger areas; not limited by the topography of the metallic substrate; having a wide range of compositions; and/or by application methods that are faster and/or less expensive. The present methods utilize infiltration to provide the wear resistant layers and, thus, differ fundamentally from methods utilizing welding and/or hardfacing application techniques.

The metallic substrate and, consequently, the surface on which the wear resistant layer is provided may be, for example, a metal or a metal alloy. In certain non-limiting embodiments, the metallic substrate may comprise one of cast iron, a steel (for example, a carbon steel or a stainless steel), nickel, a nickel alloy, titanium, a titanium alloy, aluminum, an aluminum alloy, copper, a copper alloy, cobalt, a cobalt alloy, and alloys including combinations thereof. In certain non-limiting embodiments, the metallic substrate may be a portion or region of an article of manufacture, such as, for example, an extruder, a gear box, a compressor, a pump, a reactor vessel, a container, a pipe, a tube, a valve, a valve part, a flange, a bearing, a drill bit, an earth boring bit, a mold, a die, a part or component of mining or earth moving equipment, or a radial bearing for mud motors used in oil/gas exploration. In at least one non-limiting embodiment, the article of manufacture may comprise a pipe for conducting abrasive or corrosive fluids or other materials, and the wear resistant layer according to the present disclosure may be disposed on at least a region of an interior surface of the pipe that is contacted by the fluids or other materials being transported through the pipe. The materials and fluids may be, for example, and without limitation: hot caustic materials; slag or coke particles; liquids in oil producing facilities; tar sands; or oil sands.

In various non-limiting embodiments, the hard particles may comprise at least 10 volume percent of the wear resistant layer, such as, for example, at least 25 volume percent, at least 50 volume percent, at least 75 volume percent, at least 80 volume percent, at least 85 volume percent, 10 to 90 volume percent, 25 to 75 volume percent, or 25 to 70 volume percent. In certain non-limiting embodiments, the hard particles may comprise at least one of carbide particles, nitride particles, boride particles, silicide particles, oxide particles, and particles comprising a solid solution of at least two of carbide, nitride, boride, silicide, and oxide. In certain non-limiting embodiments, the hard particles may comprise carbide particles of at least one transition metal selected from titanium, chromium, vanadium, zirconium, hafnium, tantalum, molybdenum, niobium, and tungsten.

In various non-limiting embodiments of a method according to the present disclosure, the hard particles may comprise sintered cemented carbide particles. The sintered cemented carbide particles may comprise, for example, particles including at least one carbide of a metal selected from Groups IVB, VB, and VIB of the Periodic Table dispersed in a continuous binder comprising at least one of cobalt, a cobalt alloy, nickel, a nickel alloy, iron, and an iron alloy. In certain non-limiting embodiments, the sintered cemented carbide particles may comprise particles including 60 to 98 weight percent of at least one carbide of a metal selected from Groups IVB, VB, and VIB of the Periodic Table, and 2 to 40 weight percent of a continuous binder. The continuous binder optionally may comprise at least one additive selected from tungsten, chromium, titanium, vanadium, niobium, and carbon in a concentration at any level up to the solubility limit of the additive in the continuous binder. The continuous binder of the sintered cemented carbide particles also my optionally comprise at least one additive selected from silicon, boron, aluminum, copper, ruthenium, and manganese.

In various non-limiting embodiments, the hard particles may comprise at least one of a metal powder and a metal alloy powder. In at least one non-limiting embodiment, the hard particles may comprise a cast tungsten carbide powder. In another non-limiting embodiment, the hard particles may comprise a monocrystalline tungsten carbide powder. In yet another non-limiting embodiment, the hard particles may comprise a silicon carbide powder. In certain non-limiting embodiments of the method, the hard particles have an average particle size of 0.1 to 200 micrometers, such as, for example, 1 to 200 micrometers, 0.3 to 8 micrometers, 0.3 to 10 micrometers, 0.5 to 10 micrometers, 1 to 10 micrometers, 5 to 50 micrometers, 10 to 100 micrometers, or 10 to 150 micrometers. However, it will be understood that the hard particles may have any average particle size suitable for providing a wear resistant layer produced by the method of the present disclosure.

The metallic binder material used in the method of the present disclosure may comprise, for example, at least one of copper, a copper alloy, aluminum, an aluminum alloy, iron, an iron alloy, nickel, a nickel alloy, cobalt, a cobalt alloy, titanium, a titanium alloy, magnesium, a magnesium alloy, a bronze, and a brass. In at least one non-limiting embodiment, the metallic binder material comprises a bronze consisting essentially of 78 weight percent copper, 10 weight percent nickel, 6 weight percent manganese, 6 weight percent tin, and incidental impurities. In another non-limiting embodiment, the metallic binder material comprises a bronze consisting essentially of 53 weight percent copper, 24 weight percent manganese, 15 weight percent nickel, 8 weight percent zinc, and incidental impurities. The metallic binder material optionally further comprises at least one melting point reducing constituent selected from the group consisting of boron, a boride, silicon, a silicide, chromium, and manganese. In certain embodiments, the binder materials are selected from copper-based alloys, nickel-based alloys, and cobalt-based alloys and include at least one melting point reducing constituent selected from boron, silicon, and chromium.

Figure 2:
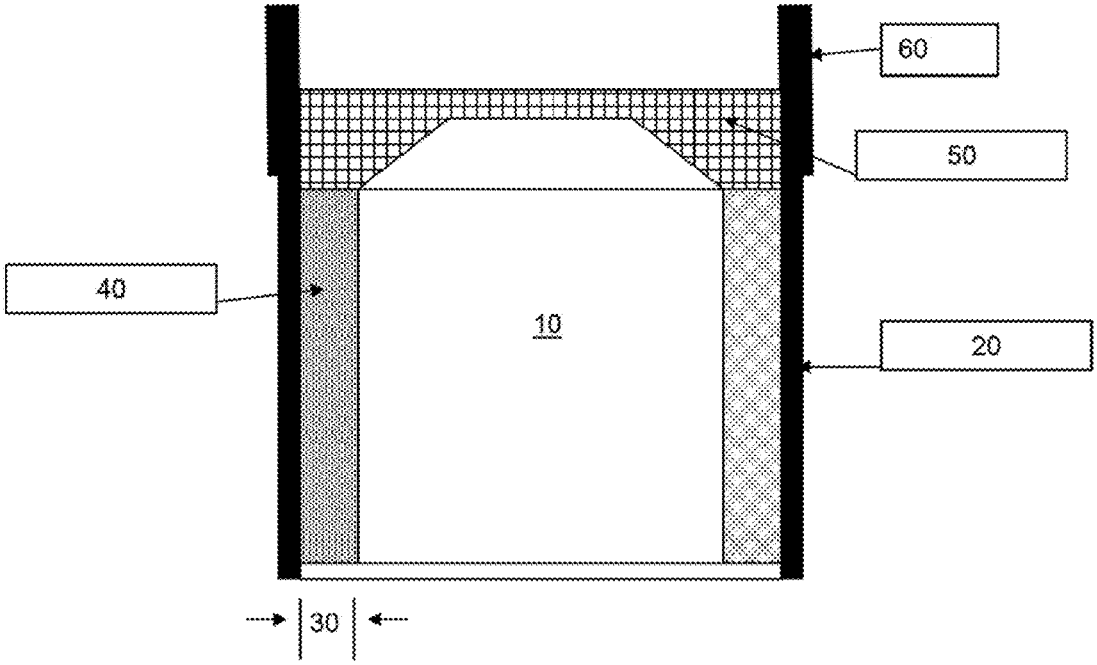
FIG. 2 is a cross-sectional view illustrating aspects of a non-limiting embodiment of a method of forming a wear resistant layer according to the present disclosure.

In various non-limiting embodiments, the wear resistant layer may be formed on an interior surface of the metallic substrate. Referring to FIG. 2, a non-limiting embodiment of a method for forming a wear resistant layer metallurgically bonded to an interior surface of metallic substrate may generally comprise: positioning a mandrel 10 proximate to a surface of a metallic substrate 20 to define a gap 30 between the mandrel 10 and the surface of the metallic substrate 20; positioning hard particles 40 adjacent the surface of the metallic substrate 20; and infiltrating the hard particles 40 with a metallic binder material 50 to form a wear resistant layer metallurgically bonded to the surface. The metallic substrate 20, hard particles 40, and metallic binder material 50 may comprise, for example, any combination of the various metallic substrates, hard particles, and metallic binder materials described herein. The method may comprise positioning a homogeneous layer of the hard particles 40 in the gap 30. The method may further comprise positioning a homogeneous layer of the metallic binder material 50 adjacent the homogeneous layer of the hard particles 40 and adjacent the mandrel 10. Alternatively, the method may comprise positioning a heterogeneous layer of the hard particles 40 and the metallic binder material 50 adjacent the mandrel 10.

In various non-limiting embodiments, the method may comprise positioning a funnel 60 adjacent to a surface of the metallic substrate 20. The funnel 60 may be configured to receive the hard particles 40 and/or metallic binder material 50. The funnel 60 may be configured to receive a homogeneous layer of the metallic binder material 50. The method may comprise positioning a homogeneous layer of the hard particles 40 in the gap 30 between the mandrel 10 and the metallic substrate 20 and positioning a homogeneous layer of the metallic binder material 50 in the gap 30 between the mandrel 10 and the funnel 60. In various embodiments, the method may comprise, after infiltrating the metallic substrate with the metallic binder material, separating the funnel 60 and the metallic substrate 20.

The gap 30 may be any suitable dimension to provide a wear resistant layer of a desired thickness. In various non-limiting embodiments, the gap may be of a constant dimension. In certain embodiments, the gap may be 1 mm to 250 mm, such as, for example, less than 40 mm, less than 25 mm, 1 mm to 100 mm, 1 mm to 50 mm, 1 mm to 20 mm, 1 mm to 10 mm, 3 mm to 10 mm, or 3 mm to 8 mm. In various non-limiting embodiments, the gap may be of a variable dimension. For example, the gap may have a first dimension at a first region of the mandrel and different dimensions at one or more other regions of the mandrel. In certain embodiments, the gap may have a first dimension between the mandrel and the metallic substrate, and the gap may have a second dimension between the mandrel and the funnel. As shown in FIG. 2, for example, the width of the gap may be constant between the mandrel and metallic substrate, and the width of the gap may be variable between the funnel and the metallic substrate.

Figures 3A, 3B:
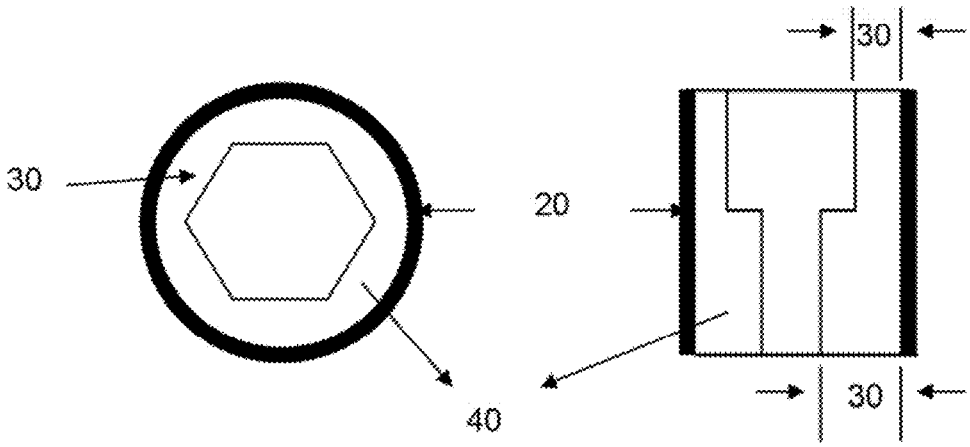
FIGS. 3A and 3B are cross-sectional views illustrating aspects of non-limiting embodiments of methods of forming wear resistant layers according to the present disclosure.

The mandrel may have any constant or variable cross-sectional shape necessary to provide a gap suitably configured to result in a wear resistant layer of a desired thickness and contour. The cross-sectional shape of the mandrel may comprise, for example, a circle, an annulus, an ellipse, an oval, a polygon, a parallelogram, a rectangle, a square, a trapezoid, a triangle, and any combination thereof. As shown in FIG. 2, in at least one embodiment, the mandrel may have a trapezoidal cross-sectional shape. As shown in FIG. 3A, in at least one embodiment, the mandrel may have a hexagonal cross-sectional shape. As shown in FIG. 3B, in at least one embodiment, the mandrel may have a cross-sectional shape that is an irregular polygon (a step profile). In various embodiments, the mandrel may comprise a graphite plug. In certain other embodiments, the mandrel may be of any suitable shape and dimensions and comprises any suitable metallic alloy having a solidus temperature at least 100° C. higher than the infiltration temperature used in the method. In yet other embodiments, the mandrel comprises a ceramic material (such as, for example, aluminum oxide, silicon carbide, or boron nitride) having a solidus temperature at least 100° C. higher than the infiltration temperature used in the method. As noted, the cross-sectional shape of the mandrel may be different in different positions on the mandrel so as to provide a suitably configured wear resistant layer.

Figure 5:
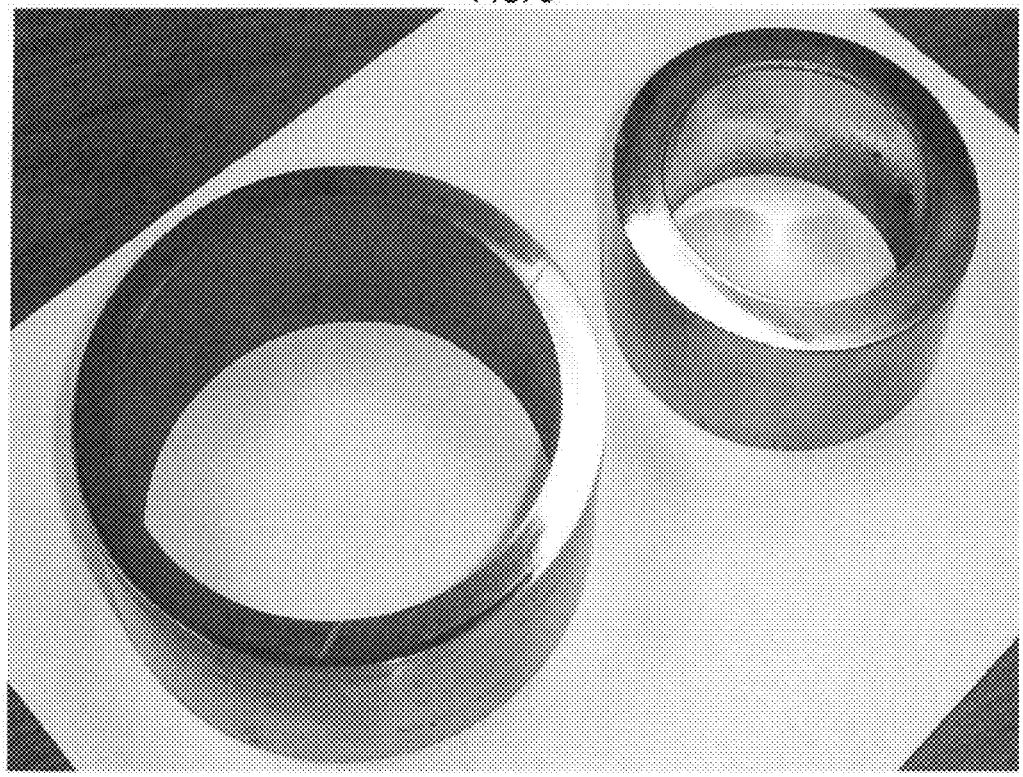
FIGS. 5-8 are photographs illustrating non-limiting embodiments of stainless steel tubes comprising a wear resistant layer on an interior surface according to the present disclosure.
Figure 6:
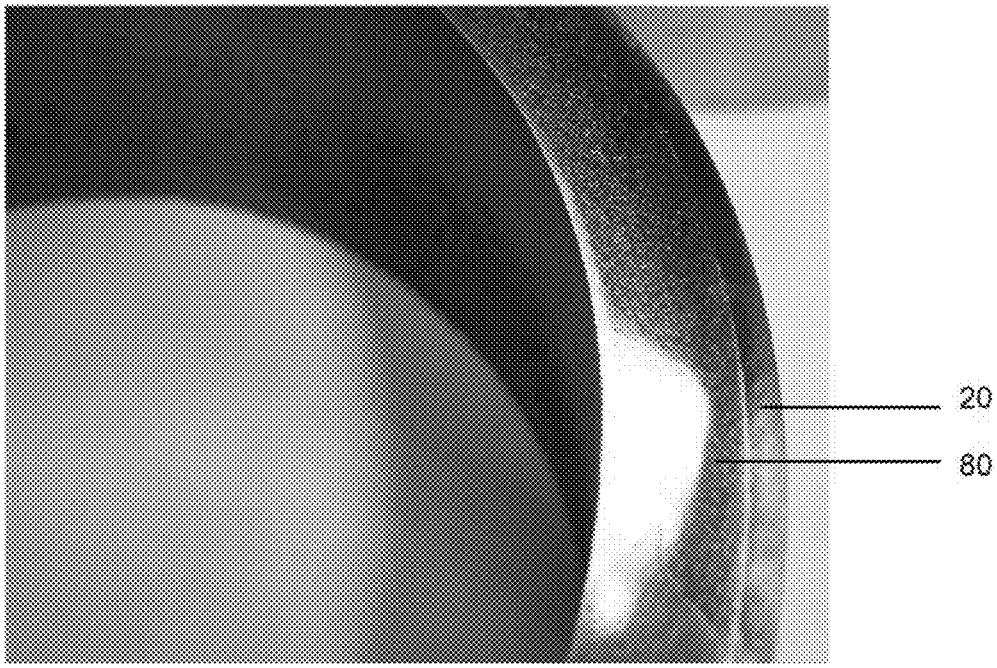
Figure 7:
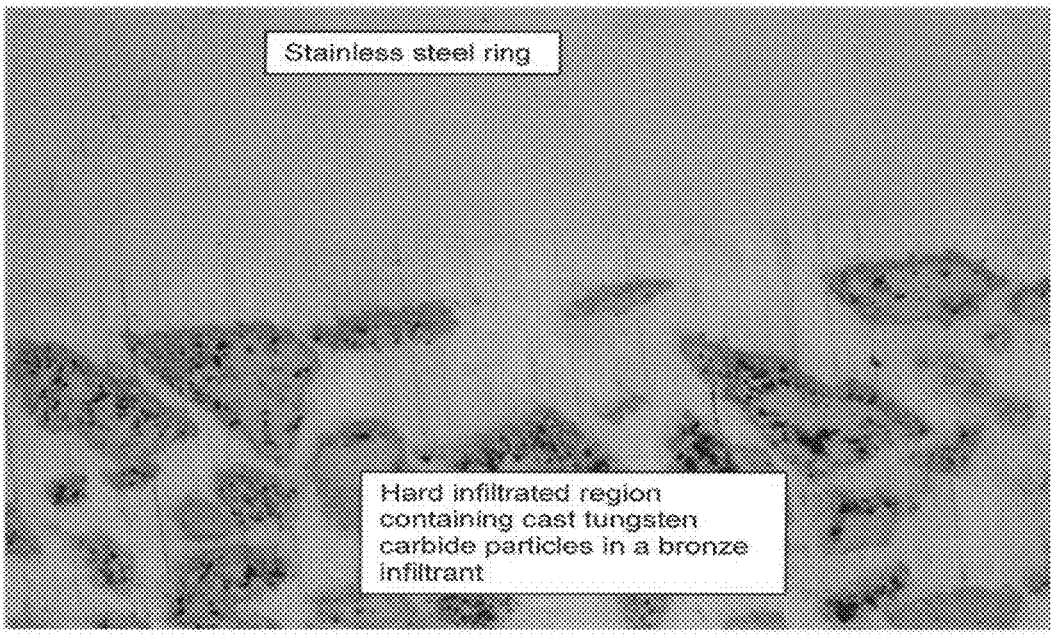
Figure 8:
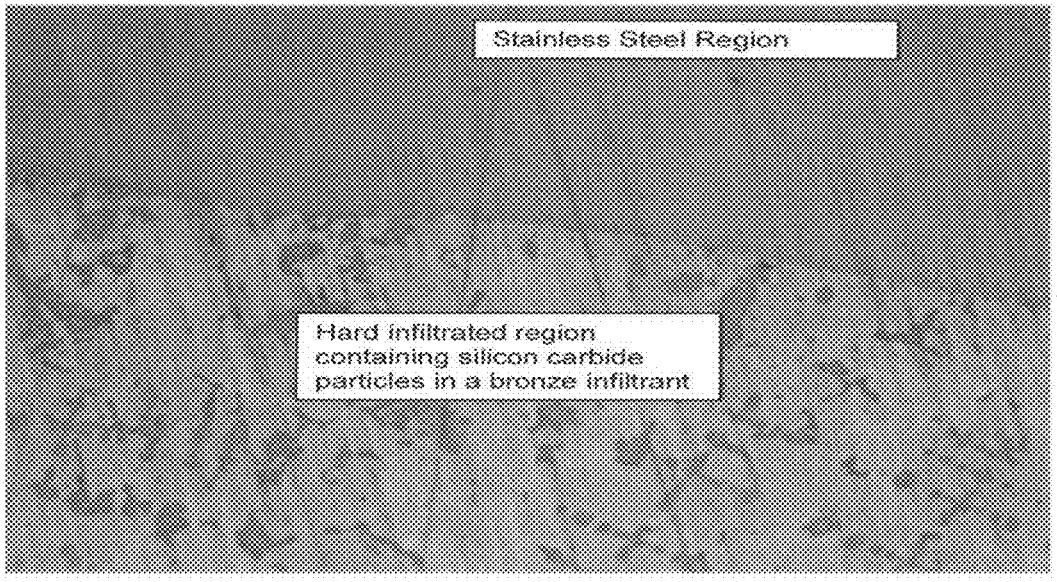

In various non-limiting embodiments, a cross-sectional shape of the wear resistant layer may be the same as or different than the cross-sectional shape of the metallic substrate. As described above, the thickness of the wear resistant layer may be related to the cross-sectional shape of the mandrel and the gap. In various embodiments, the cross-sectional shape of the mandrel and the gap at various points may be configured to provide a wear resistant layer having a cross-sectional shape that is a shape selected from, for example, a circle, an ellipse, an oval, a polygon, a parallelogram, a rectangle, a square, a trapezoid, and a triangle. As shown in FIGS. 5 and 6, in various non-limiting embodiments the cross-sectional shape of the wear resistant layer may be the same as a cross-sectional shape of the metallic substrate. In FIGS. 5 and 6, the wear resistant layer has a circular cross-sectional shape, and the metallic substrate also has a circular cross-sectional shape. As shown in FIGS. 3A and 3B, in other non-limiting embodiments, the cross-sectional shape of the wear resistant layer may be different than the cross-sectional shape of the metallic substrate. In the portion of FIG. 3A showing the transverse cross-section (left portion), the wear resistant layer has a hexagonal internal cross-sectional shape, and the metallic substrate has a circular cross-sectional shape. In the portion of FIG. 3A showing the longitudinal cross-section (right portion), the wear resistant layer has an irregular polygonal (a step profile) cross-sectional shape, and the metallic substrate has a rectangular cross-sectional shape.

In various embodiments, the contour of the wear resistant layer may or may not be identical to the contour of the surface being coated. As described above, conventional methods of applying wear resistant materials are line-of-sight methods in which the contour of the wear resistant material is generally the same as the contour of the surface being coated. In contrast, in various non-limiting embodiments of the method of the present disclosure, the contour of the one or more wear resistant layers may be different than the contour of the surface being coated. As shown in the transverse cross-section of FIG. 3A, for example, the contour of the wear resistant layer may be hexagonal, and the contour of the metallic substrate may be circular. As shown in the longitudinal cross-section of FIG. 3A, the contour of the wear resistant layer may be an irregular polygon (a step profile), and the contour of the metallic substrate may be rectangular. In various non-limiting embodiments, the present method may comprise providing a mandrel having a suitable cross-sectional shape and/or contour to provide a wear resistant layer having a desired contour. For example, the mandrel may provide a wear resistant layer having a screw thread contour to the interior surface of a metallic substrate having a circular contour.

In various embodiments, thickness of the wear resistant layer may be less than, equal to, or greater than the thickness of the metallic substrate. In certain non-limiting embodiments, the thickness of the wear resistant layer may be, for example, 1 mm to 250 mm, such as, for example, less than 40 mm, less than 25 mm, 1 mm to 100 mm, 1 mm to 50 mm, 1 mm to 20 mm, 1 mm to 10 mm, or 0.3 mm to 10 mm. In at least one embodiment, the thickness of the wear resistant layer may be greater than 100 mm. In at least one embodiment, the thickness of the wear resistant layer may be greater than 25 mm. As shown in FIG. 6, in various embodiments, the thickness of the wear resistant layer 80 may be greater than the thickness of the metallic substrate 20.

Figure 4:
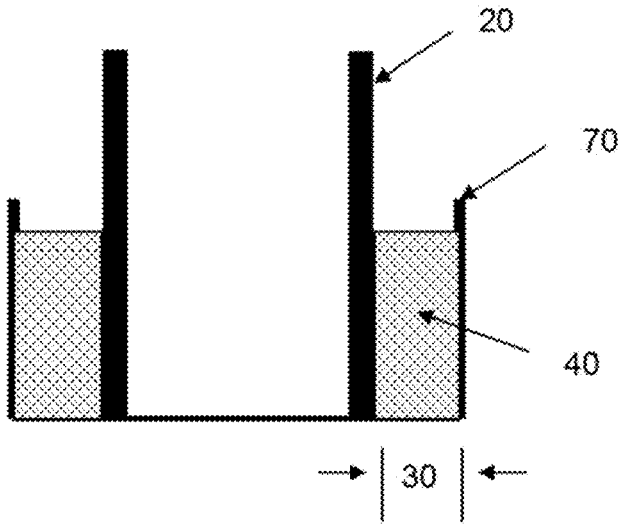
FIG. 4 is a cross-sectional view illustrating aspects of non-limiting embodiments of methods of forming a wear resistant layer according to the present disclosure.

In various non-limiting embodiments, the wear resistant layer may be formed on an exterior surface of the metallic substrate. Referring to FIG. 4, a non-limiting embodiment of a method for forming a wear resistant layer metallurgically bonded to an exterior surface of a metallic substrate may generally comprise disposing the metallic substrate 20 in a mold 70 to define a gap 30 between the mold 70 and the exterior surface of the metallic substrate 20, positioning hard particles 40 adjacent the exterior surface of the metallic substrate 20 in the mold 70, and infiltrating the hard particles 40 with a metallic binder material (not shown) to form a wear resistant layer metallurgically bonded to the exterior surface. The method may comprise positioning a homogeneous layer of the hard particles 40 in the gap 30. The method may further comprise positioning a homogeneous layer of the metallic binder material adjacent the homogeneous layer of the hard particles 40 in the mold 70. In various embodiments, the method may further comprise positioning a funnel 60 adjacent to the metallic substrate 20. As described above, the funnel 60 may be configured to receive the hard particles 40 and/or the metallic binder material. The method may comprise positioning at least a portion of the homogeneous layer of the metallic binder material in the funnel 60.

In various non-limiting embodiments, as described above, the gap may be any suitable dimension to provide a wear resistant layer of a desired thickness. The gap may have a constant dimension or variable dimensions. In certain non-limiting embodiments, the gap between the mandrel and the surface of the metallic substrate may be 1 mm to 250 mm, such as, for example, less than 40 mm, less than 25 mm, 1 mm to 100 mm, 1 mm to 50 mm, 1 mm to 20 mm, and 1 mm to 10 mm. When the article and mandrel are positioned in a mold, for example, the gap may comprise a first dimension at a first region of the mold and different dimensions at one or more other regions of the mold. In certain embodiments in which a funnel is utilized, the gap may comprise a first dimension between the mold and the metallic substrate and a second dimension between the metallic substrate and the funnel.

In various non-limiting embodiments of the method according to the present disclosure, a cross-sectional shape and dimensions of the mold may comprise any suitable shape and dimensions to provide a gap suitable to form a wear resistant layer of a desired shape and thickness. The cross-sectional dimension of the mold may be any combination of the mandrel's cross-sectional dimensions and contours described above. The cross-sectional shape of the mold may comprise, for example, a circle, an annulus, an ellipse, an oval, a polygon, a parallelogram, a rectangle, a square, a trapezoid, a triangle, and any combination thereof. As shown in FIG. 4, in at least one embodiment, the mold may be a rectangle. In various embodiments, the mold may comprise a graphite mold. In certain embodiments, the mold comprises any suitable metallic alloy having a solidus temperature at least 100° C. higher than the infiltration temperature used in the method. In yet other embodiments, the mold comprises a ceramic material (such as, for example, aluminum oxide, silicon carbide, or boron nitride) having a solidus temperature at least 100° C. higher than the infiltration temperature used in the method. More generally, the mold may comprise any suitable material that may be included in a mandrel used in certain embodiments of the method of the present disclosure.

In various embodiments, a cross-sectional shape of the wear resistant layer may be the same as or different than the cross-sectional shape of the metallic substrate. The thickness of the wear resistant layer may be related to the cross-sectional shape of the mold and the gap between the mold and the metallic substrate. In various non-limiting embodiments, a cross-sectional shape of the mold and the gap may be configured to provide a wear resistant layer having, for example, any of the cross-sectional shapes and contours described herein, such as, for example, a circle, an ellipse, an oval, a polygon, a parallelogram, a rectangle, a square, a trapezoid, and a triangle. Also as noted, in various embodiments the contour of the wear resistant layer may or may not be identical to the contour of the surface being coated. Non-limiting embodiments of the present method may comprise providing a mold having a suitable cross-sectional shaper and/or contour to provide a wear resistant layer of a desired contour on a metallic substrate (article) disposed in the mold. For example, the mold may provide a wear resistant layer having a screw thread contour on an exterior surface of a metallic substrate having a circular contour.

In various embodiments, infiltrating the hard particles with the metallic binder material may comprise infiltrating at an infiltration temperature. In particular non-limiting embodiments, the infiltrating temperature may be in the range of 700° C. up to 1350° C. For certain non-limiting embodiments of the method, such as non-limiting embodiments in which the binder is aluminum or an aluminum-based alloy, the infiltrating temperature range may be 700° C. to 850° C. For certain non-limiting embodiments of the method in which the binder is copper or a copper-based alloy, the infiltrating temperature range may be 1000° C. to 1250° C. For certain non-limiting embodiments of the method in which the binder is nickel or a nickel-based alloy and includes minor levels of boron, silicon, and/or chromium, the infiltrating temperature range may be 1200° C. to 1400° C. The metallic substrate (article) and/or the metallic binder material may be held at the infiltrating temperature in order to melt the metallic binder material and allow it to infiltrate pores intermediate the hard particles. In certain non-limiting embodiments, for example, the infiltration temperature may be 50° C. to 100° C. greater than the liquidus temperature of the metallic binder material. In certain embodiments of the method, the hard particles may have a solidus temperature at least 50° C. greater than a liquidus temperature of the metallic binder material. Also, in certain embodiments of the method, the metallic binder material may have a liquidus temperature at least 200° C. greater than a liquidus temperature of the metallic substrate. The melting temperature of the hard particles may be greater than a melting temperature of the metallic binder material. In certain non-limiting embodiments, the substrate material has a solidus temperature ranging from 1350° C. to 1600° C. depending upon the particular alloy system involved (for example, steels, titanium, nickel, or cobalt-based alloys). In certain non-limiting embodiments, the melting temperature of the hard particles ranges from 1600° C. to 3500° C., depending upon the composition of the hard particles. For example, tungsten carbide-based hard particles may have a melting temperature in the range of 2800° C. to 3500° C. range, while aluminum oxide and silicon carbide hard particles may have a melting temperature in the range of 1800° C. to 2500° C. The method may comprise heating the metallic substrate at a temperature greater than the melting temperature of the metallic binder material and less than the melting temperature of the hard particles for less than one hour. In certain other embodiments of the method, the method may comprise heating the metallic substrate at a temperature greater than the melting temperature of the metallic binder material and less than the melting temperature of the hard particles for one hour or more.

In various embodiments, infiltrating the hard particles with the metallic binder material comprises dispersing the hard particles in the metallic binder material. Dispersing the hard particles in the metallic binder material may comprise melting a homogeneous layer of the metallic binder material and flowing molten metallic binder material into pores intermediate the hard particles. For example, when the homogeneous layer of the metallic binder material illustrated in FIG. 2 is heated to an infiltration temperature (which is at least as high as the liquidus temperature of the metallic binder material), the molten metallic binder material may flow under gravity into pores intermediate the hard particles. In various embodiments, dispersing the hard particles in the metallic binder material may comprise melting the metallic binder material in a heterogeneous layer of the hard particles and metallic binder material, and flowing molten metallic binder material into pores intermediate the hard particles. In various embodiments, infiltrating the hard particles with the metallic binder material may comprise wetting the hard particles with the metallic binder material.

In various non-limiting embodiments, the method may comprise, after infiltrating the metallic substrate with the metallic binder material, cooling the wear resistant layer. Relatively small articles may be placed in an insulated chamber to slow cooling and inhibit thermal cracking. Larger articles may be allowed to cool at room temperature, without or without assisted cooling. Those having ordinary skill will be able to determine a suitable cooling regimen for a particular article and wear resistant layer.

In various non-limiting embodiments, the method may comprise, after infiltrating the hard particles with the metallic binder material, removing the mandrel and/or funnel by at least one of turning, milling, drilling, and electrical discharge machining. In various embodiments, the infiltration temperature may be greater than a decomposition temperature of the mandrel. For example, infiltrating the hard particles with the metallic binder material may vaporize the mandrel. In various embodiments, the method may comprise separating one of the funnel and mold from the metallic substrate. The article may be inspected and, if desired, may be further processed as needed to remove any oxide scale and/or provide a desired surface finish on the wear resistant layer.

EXAMPLES

The various embodiments described herein may be better understood when read in conjunction with the following representative examples, which are provided for purposes of illustration only and not as a limitation on the scope of the present disclosure or the attached claims.

Example 1

Figure 9:
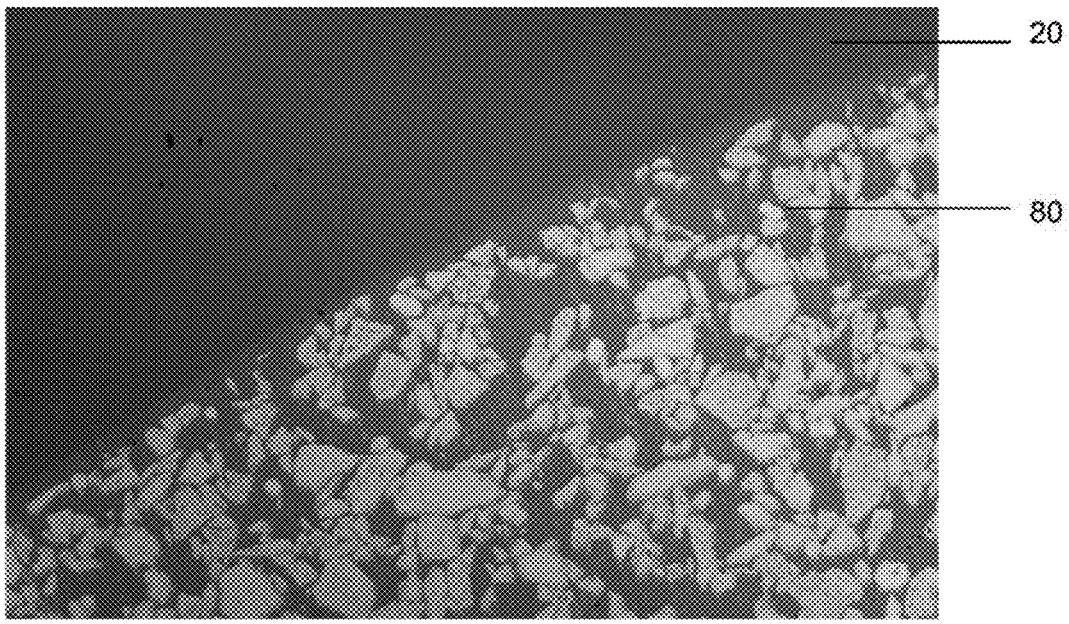
FIG. 9 is a photomicrograph illustrating a non-limiting embodiment of a stainless steel tube according to the present disclosure having a wear resistant layer on the interior surface thereof comprising cast carbide ($WC+W_2C$) particles infiltrated by a bronze alloy (by weight, 78% copper, 10% nickel, 6% manganese, and 6% tin).

FIG. 9 is a photograph illustrating a stainless steel (Type 304) tube comprising a wear resistant layer on the interior surface of the stainless steel tube formed by an embodiment of a method according to the present disclosure. A mandrel comprising a cylindrical plug was machined from graphite. The outside diameter of the plug was about 12.7 mm smaller than the inside diameter of the stainless steel tube. The length of the plug was approximately the same length as the stainless steel tube. The plug was placed in the stainless steel tube and hard particles in the form of cast tungsten carbide powder ($WC+W_2C$) were disposed in the gap between the graphite plug and the stainless steel tube. A graphite funnel was placed on top of the assembly. Pellets of a metallic binder material comprising bronze (in weight percentages, 78% copper, 10% nickel, 6% manganese, and 6% tin) were placed in the funnel. The liquidus temperature of the bronze binder material is about 1050° C. The general arrangement of the assembly of the plug, stainless steel tube, hard particles, funnel, and metallic binder material is illustrated schematically in cross-section in FIG. 2. The assembly may be positioned in a preheated furnace (including an air atmosphere) at a temperature in the 1100° C. to 1200° C. range. In the example, the assembly was positioned in the preheated furnace at a temperature of about 1180° C. for about 40 minutes. The temperature inside the furnace exceeded the liquidus temperature of the bronze, but was less than the solidus temperature of the tungsten carbide particles, which is greater than 3000° C. The bronze pellets melted and infiltrated the pores intermediate the particles of the cast tungsten carbide powder. The stainless steel tube (now including a wear resistant layer of tungsten carbide particles dispersed in a bronze binder matrix) and the mandrel were cooled to about room temperature and cleaned by machining and/or shot blasting. The mandrel was broken or machined away, and excess material was removed by grinding. FIG. 9 illustrates the microstructure of the metallurgical bond region between the stainless steel tube 20 and the wear resistant layer 80. As shown in FIG. 9, the tungsten carbide-bronze wear resistant layer 80, which comprised tungsten carbide (light phase in region 80) in a bronze binder (dark phase in region 80), was metallurgically bonded to the interior surface of the stainless steel tube 20.

Example 2

Figure 10:
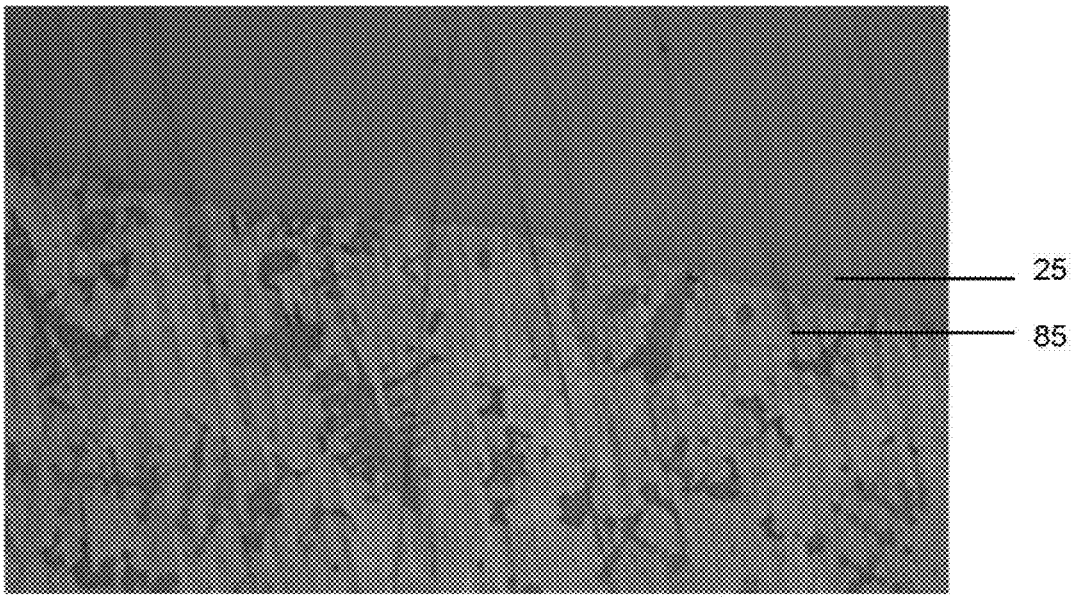
FIG. 10 is a photomicrograph illustrating a non-limiting embodiment of a stainless steel tube according to the present disclosure comprising a wear resistant layer on the interior surface thereof comprising silicon carbide particles infiltrated by a bronze alloy (by weight, 78% copper, 10% nickel; 6% manganese, and 6% tin).

FIG. 10 is a photograph illustrating a stainless steel (Type 304) tube comprising a wear resistant layer on the interior surface of the stainless steel tube formed by an embodiment of a method according to the present disclosure. A mandrel comprising a cylindrical plug was machined from graphite. The outside diameter of the plug was about 12.7 mm smaller than the inside diameter of the stainless steel tube. The length of the plug was approximately the same length as the stainless steel tube. The plug was placed in the stainless steel tube and hard particles in the form of silicon carbide particles having an average particle size of about 250 μm were disposed in the gap between the graphite plug and the stainless steel tube. A graphite funnel was placed on top of the assembly. Pellets of a metallic binder material comprising bronze (in weight percentages, 78% copper, 10% nickel, 6% manganese, and 6% tin) were placed in the funnel. The general arrangement of the assembly of the plug, stainless steel tube, hard particles, funnel, and metallic binder material is illustrated schematically in cross-section in FIG. 2. The assembly was positioned in a preheated furnace (air atmosphere) at a temperature of about 1180° C. for about 40 minutes. The temperature inside the furnace exceeded the liquidus temperature of the bronze. The bronze pellets melted and infiltrated the pores intermediate the particles of silicon carbide. The stainless steel tube (now including a wear resistant layer of silicon carbide particles dispersed in a bronze binder matrix) and the mandrel were cooled to about room temperature and cleaned by machining and/or shot blasting. The mandrel was broken or machined away, and excess material was removed by grinding. FIG. 10 illustrates the microstructure of the metallurgical bond region between the stainless steel tube 25 and the wear resistant layer 85. As shown in FIG. 10, the wear resistant layer 85, which comprised silicon carbide (dark phase in region 85) in a bronze binder (lighter phase in region 85), was metallurgically bonded to the interior surface of the stainless steel tube 25.

Example 3

Figure 11:
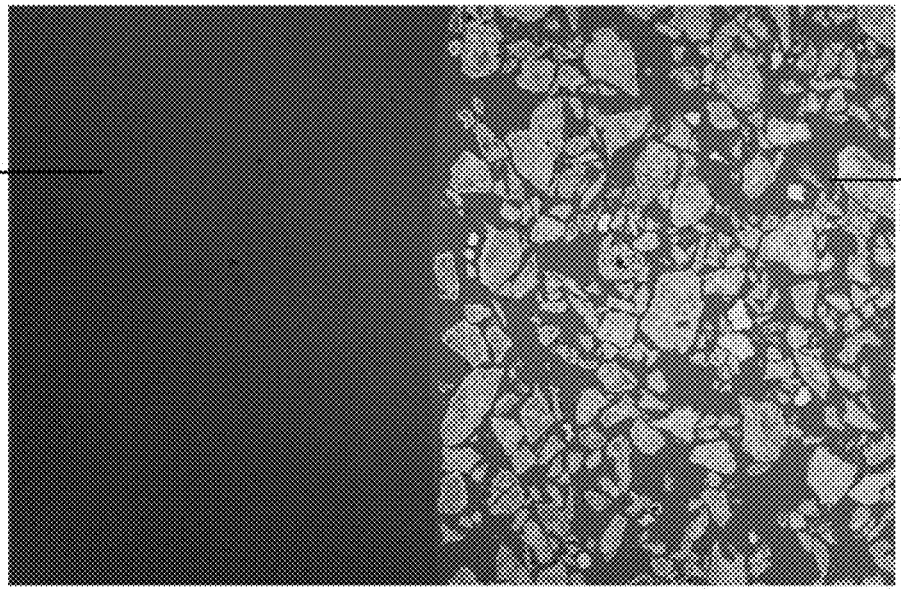
FIG. 11 is a photomicrograph illustrating a non-limiting embodiment of a stainless steel tube according to the present disclosure comprising a wear resistant layer on the interior surface thereof comprising cast carbide ($WC+W_2C$) particles infiltrated by a brass alloy (by weight, 53% copper, 15% nickel, 24% manganese, and 8% zinc).

FIG. 11 is a photograph illustrating a stainless steel (Type 304) tube comprising a wear resistant layer on the interior surface of the stainless steel tube formed by an embodiment of a method according to the present disclosure. A mandrel comprising a cylindrical plug was machined from graphite. The outside diameter of the plug was about 12.7 mm smaller than the inside diameter of the stainless steel tube. The length of the plug was approximately the same length as the stainless steel tube. The plug was placed in the stainless steel tube and hard particles in the form of cast tungsten carbide powder ($WC+W_2C$) were placed in the gap between the graphite plug and the stainless steel tube. A graphite funnel was placed on top of the assembly. Pellets of a metallic binder material comprising brass were placed in the funnel. The assembly was positioned in a preheated furnace (air atmosphere) at a temperature of about 1160° C. for about 40 minutes. The temperature inside the furnace exceeded the liquidus temperature of the brass. The brass pellets melted and infiltrated the pores intermediate the particles of tungsten carbide. The stainless steel tube (now including a wear resistant layer of tungsten carbide particles dispersed in a brass binder matrix) and the mandrel were cooled to about room temperature and cleaned by machining and/or shot blasting. The mandrel was broken or machined away, and excess material was removed by grinding. FIG. 11 illustrates the microstructure of the metallurgical bond region between the stainless steel tube 27 and the wear resistant layer 87. As shown in FIG. 11, the wear resistant layer 87, which comprised tungsten carbide (light phase in region 87) in a brass binder (dark phase in region 87), was metallurgically bonded to the interior surface of the stainless steel tube 27.

Example 4

Figure 12:
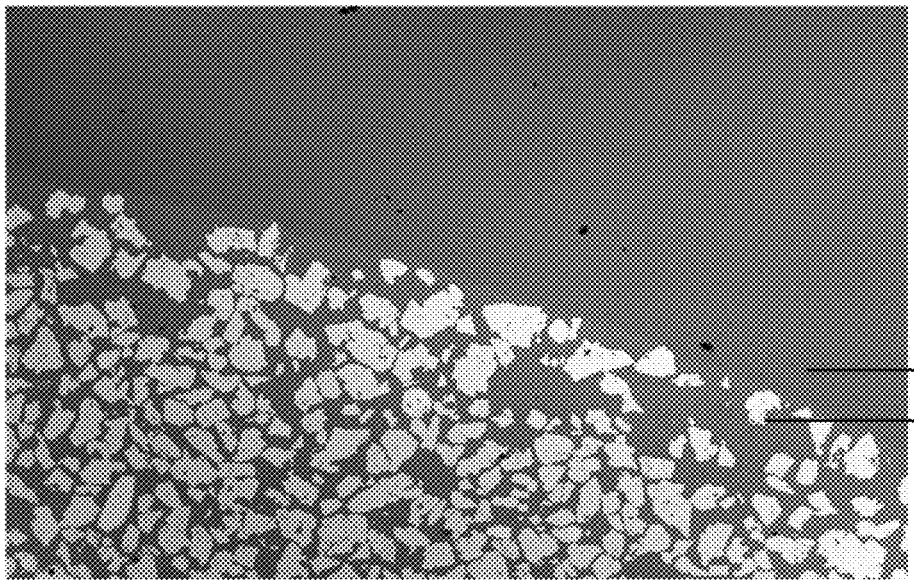
FIG. 12 is a photomicrograph illustrating a non-limiting embodiment of a stainless steel tube according to the present disclosure comprising a wear resistant layer on the interior surface thereof comprising tungsten carbide particles infiltrated by a brass (by weight, 53% copper, 15% nickel, 24% manganese, and 8% zinc).

FIG. 12 is a photograph illustrating a stainless steel (Type 304) tube comprising a wear resistant layer on the interior surface of the stainless steel tube formed by an embodiment of the method according to the present disclosure. A mandrel comprising a cylindrical plug was machined from graphite. The outside diameter of the plug was about 12.7 mm smaller than the inside diameter of the stainless steel tube. The length of the plug was approximately the same length as the length of the stainless steel tube. The plug was placed in the stainless steel tube and hard particles in the form of monocrystalline tungsten carbide powder were placed in the gap between the graphite plug and the stainless steel tube. A graphite funnel was placed on top of the assembly. Pellets of a metallic binder material comprising brass ((in weight percentages, 53% copper, 15% nickel, 24% manganese, and 8% zinc) were placed in the funnel. The general arrangement of the assembly of the plug, stainless steel tube, hard particles, funnel, and metallic binder material is illustrated schematically in cross-section in FIG. 2. The assembly was positioned in a preheated furnace (air atmosphere) at a temperature of 1160° C. for 40 minutes. The temperature inside the furnace exceeded the liquidus temperature of the brass. The brass pellets melted and infiltrated the pores intermediate the particles of tungsten carbide. The stainless steel tube (now including a wear resistant layer of tungsten carbide particles dispersed in a brass binder matrix) and the mandrel were cooled to about room temperature and cleaned by machining and/or shot blasting. The mandrel was broken ormachined away, and excess material was removed by grinding. FIG. 12 illustrates the microstructure of the metallurgical bond region between the stainless steel tube 29 and the wear resistant layer 89. As shown in FIG. 12, the wear resistant layer 89, which comprised tungsten carbide (light phase in region 89) in a brass binder (dark phase in region 89), was metallurgically bonded to the interior surface of the stainless steel tube 29.

All documents cited herein are incorporated herein by reference, but only to the extent that the incorporated material does not conflict with existing definitions, statements, or other documents set forth herein. To the extent that any meaning or definition of a term in this document conflicts with any meaning or definition of the same term in a document incorporated by reference, the meaning or definition assigned to that term in this document shall govern. The citation of any document is not to be construed as an admission that it is prior art.

While particular embodiments have been illustrated and described herein, it those skilled in the art will understand that various other changes and modifications can be made without departing from the spirit and scope of the invention. Those skilled in the art will recognize, or be able to ascertain using no more than routine experimentation, numerous equivalents to the specific methods described herein, including alternatives, variants, additions, deletions, modifications and substitutions. This disclosure, including the appended claims, is intended to cover all such equivalents that are within the spirit and scope of this invention.

What is claimed is:

1. A method of forming a wear resistant layer on at least a region of a surface of a metallic substrate, the method comprising:

positioning a mandrel proximate to the surface of the metallic substrate to define a gap between the mandrel and the surface of the metallic substrate;

positioning a homogeneous layer consisting of hard particles in the gap adjacent the metallic substrate;

positioning a homogeneous layer consisting of a solid metallic binder material adjacent the homogeneous layer consisting of hard particles; and infiltrating the homogeneous layer consisting of hard particles with the metallic binder material in the homogeneous layer consisting of the solid metallic binder material, thereby binding together the hard particles to form the wear resistant layer metallurgically bonded to the surface of the metallic substrate.

2. The method of claim 1, wherein the metallic substrate comprises one of a steel, nickel, a nickel alloy, titanium, a titanium alloy, aluminum, an aluminum alloy, copper, a copper alloy, cobalt, and a cobalt alloy.

3. The method of claim 1, wherein the metallic binder material comprises at least one of copper, a copper alloy, aluminum, an aluminum alloy, iron, an iron alloy, nickel, a nickel alloy, cobalt, a cobalt alloy, titanium, a titanium alloy, magnesium, a magnesium alloy, a bronze, and a brass.

4. The method of claim 1, wherein the metallic binder material comprises a bronze consisting essentially of 78 weight percent copper, 10 weight percent nickel, 6 weight percent manganese, 6 weight percent tin, and incidental impurities.

5. The method of claim 1, wherein the metallic binder material comprises a bronze consisting essentially of 53 weight percent copper, 24 weight percent manganese, 15 weight percent nickel, 8 weight percent zinc, and incidental impurities.

6. The method of claim 1, wherein the metallic binder material further comprises at least one melting point reducing constituent selected from the group consisting of boron, a boride, silicon, a silicide, chromium, and manganese.

7. The method of claim 1, wherein the hard particles comprise at least one of carbide particles, nitride particles, boride particles, silicide particles, oxide particles, and particles comprising a solid solution of at least two of carbide, nitride, boride, silicide, and oxide.

8. The method of claim 7, wherein the hard particles comprise carbide particles of at least one transition metal selected from titanium, chromium, vanadium, zirconium, hafnium, tantalum, molybdenum, niobium, and tungsten.

9. The method of claim 1, wherein the hard particles comprise sintered cemented carbide particles including at least one carbide of a metal selected from Groups IVB, VB, and VIB of the Periodic Table dispersed in a continuous binder comprising at least one of cobalt, a cobalt alloy, nickel, a nickel alloy, iron, and an iron alloy.

10. The method of claim 9, wherein the sintered cemented carbide particles comprise:

60 to 98 weight percent of at least one carbide of a metal selected from Groups IVB, VB, and VIB of the Periodic Table; and 2 to 40 weight percent of the continuous binder.

11. The method of claim 9, wherein the continuous binder of the sintered cemented carbide particles further comprises at least one additive selected from tungsten, chromium, titanium, vanadium, niobium, and carbon in a concentration up to the solubility limit of the additive in the continuous binder.

12. The method of claim 9, wherein the continuous binder of the sintered cemented carbide particles further comprises at least one additive selected from silicon, boron, aluminum, copper, ruthenium, and manganese.

13. The method of claim 1, wherein the hard particles comprise at least one of a metal powder and a metal alloy powder.

14. The method of claim 1, wherein the hard particles have an average particle size of 1 to 200 micrometers.

15. The method of claim 1, wherein a melting temperature of the hard particles is greater than a melting temperature of the metallic binder material.

16. The method of claim 15, wherein infiltrating, the homogenous layer consisting of hard articles with the metallic binder material comprises heating the metallic substrate to a temperature greater than the melting temperature of the metallic binder material and less than the melting temperature of the hard particles for less than one hour.

17. The method of claim 1, wherein the hard particles have a solidus temperature at least 50° C. greater than a liquidus temperature of the metallic binder material.

18. The method of claim 1, wherein infiltrating the homogenous layer consisting of hard particles with the metallic binder material comprises infiltrating at a temperature 50° C. to 100° C. greater than the liquidus temperature of the metallic binder material.

19. The method of claim 1, wherein infiltrating the homogeneous layer consisting of hard particles with the metallic binder material comprises melting the homogeneous layer consisting of the solid metallic binder material and flowing the molten metallic binder material into pores intermediate the hard particles.

20. The method of claim 1, wherein the wear resistant layer comprises at least 75 volume percent of the hard particles.

21. The method of claim 1, wherein the wear resistant layer comprises 25 to 75 volume percent of the hard particles.

22. The method of claim 1, wherein the wear resistant layer comprises 10 to 90 volume percent of the hard particles.

23. The method of claim 1, wherein a thickness of the wear resistant layer is from 1 mm to 250 mm.

24. The method of claim 1, wherein a thickness of the wear resistant layer is greater than 25 mm.

25. The method of claim 1, wherein a cross-sectional shape of the wear resistant layer is one of a circle, an ellipse, a parallelogram, a rectangle, a square, a trapezoid, a triangle, and combinations thereof.

26. The method of claim 1, wherein the wear resistant layer comprises a first cross-sectional shape in a first region selected from one of a circle, an ellipse, a parallelogram, a rectangle, a square, a trapezoid, a triangle, and combinations thereof, and a second cross-sectional shape in a second region selected from one of a circle, an ellipse, a parallelogram, a rectangle, a square, a trapezoid, a triangle, and combinations thereof.

27. The method of claim 1, wherein a cross-sectional shape of the wear resistant layer differs from a cross-sectional shape of the metallic substrate, and wherein the metallic substrate has a circular cross-sectional shape.

28. The method of claim 1, wherein a contour of the wear resistant layer differs from a contour of the metallic substrate, and wherein the contour of the wear resistant layer is a screw thread contour.

29. The method of claim 1, wherein the gap is less than 25.4 mm.

30. The method of claim 1, further comprising, after infiltrating the homogeneous layer consisting of hard particles with the metallic binder material:

removing the mandrel by at least one of turning, milling, drilling, and electrical discharge machining.

31. The method of claim 1, wherein a cross-sectional shape of the mandrel comprises one of a circle, an ellipse, a parallelogram, a rectangle, a square, a trapezoid, a triangle, and combinations thereof.

32. The method of claim 1, further comprising, after infiltrating the homogeneous layer consisting of hard particles with the metallic binder material:

cooling the wear resistant layer.

33. The method of claim 1, further comprising forming an article of manufacture comprising the substrate and the wear resistant layer.

34. The method of claim 33, wherein the article of manufacture is one of a pipe, a tube, a valve, a valve part, a flange, a bearing, a drill bit, an earth boring bit, a die, and a container.

35. The method of claim 33, wherein the article of manufacture comprises wear surfaces of parts and components used in earth moving equipment.

36. The method of claim 1, with the proviso that the wear resistant layer is not formed by any of welding and hardfacing.

37. The method of claim 1, wherein the wear resistant layer is metallurgically bonded to at least one of an interior surface of the metallic substrate and an exterior surface of the metallic substrate.

38. The method of claim 1, further comprising, prior to positioning the hard particles adjacent the metallic substrate:

positioning the metallic substrate in a mold to define a gap between the mold and the metallic substrate.

39. The method of claim 38, wherein the gap is less than 25.4 mm.

40. The method of claim 38, further comprising:

positioning a homogeneous layer of the metallic binder material adjacent a homogeneous layer of the hard particles in the mold.

41. The method of claim 38, wherein a cross-sectional dimension of the mold comprises one of a circle, an ellipse, a parallelogram, a rectangle, a square, a trapezoid, a triangle, and combinations thereof.

42. A method of forming a wear resistant layer on at least a region of a surface of a metallic substrate comprising one of a steel, nickel, a nickel alloy, titanium, a titanium alloy, aluminum, an aluminum alloy, copper, a copper alloy, cobalt, and a cobalt alloy, the method comprising:

positioning a mandrel proximate to the surface of the metallic substrate to define a gap between the mandrel and the surface of the metallic substrate;

positioning hard particles comprising at least one of carbide particles, nitride particles, boride particles, silicide particles, oxide particles, and particles comprising a solid solution of at least two of carbide, nitride, boride, silicide, and oxide in the gap adjacent the metallic substrate;

positioning a metallic binder material comprising at least one of copper, a copper alloy, aluminum, an aluminum alloy, iron, an iron alloy, nickel, a nickel alloy, cobalt, a cobalt alloy, titanium, a titanium alloy, magnesium, a magnesium alloy, a bronze, and a brass adjacent the hard particles; and infiltrating the hard particles with the metallic binder material, thereby binding together the hard particles to form the wear resistant layer metallurgically bonded to the surface;

wherein a cross-sectional shape of the metallic substrate differs from a cross-sectional shape of the wear resistant layer the cross-section taken perpendicular to the longitudinal axis passing through the metallic substrate and wear resistant layer.

43. The method of claim 42, wherein positioning the hard particles adjacent the metallic substrate comprises positioning a homogeneous layer consisting of the hard particles in the gap.

44. The method of claim 43, further comprising, after infiltrating the hard particles with the metallic binder material:

removing the mandrel by at least one of turning, milling, drilling, and electrical discharge machining.

45. The method of claim 44, further comprising, after infiltrating the hard particles with the metallic binder material:

cooling the wear resistant layer.

46. The method of claim 1, wherein:

the homogeneous layer consisting of hard particles contacts the metallic substrate and the mandrel; and the homogeneous layer consisting of solid metallic binder material contacts the homogeneous layer consisting of hard particles.

47. The method of claim 1, with the proviso that the wear resistant layer is not viscous when applied to the surface of the metallic substrate.

48. The method of claim 1, wherein the gap comprises a variable dimension between the mandrel and the surface of the metallic substrate.

49. The method of claim 31, wherein the cross-sectional shape of the mandrel differs from the cross-sectional shape of the metallic substrate, and wherein the cross-sectional shape of the metallic substrate is a parallelogram.

50. The method of claim 1, wherein the metallic substrate is at least a part of an article of manufacture selected from a pipe, a tube, a valve, a flange, a bearing, a drill bit, an earth boring bit, a die, a container, and a component of an earth moving apparatus.

51. The method of claim 1, wherein the wear resistant layer is metallurgically bonded to an exterior surface of the metallic substrate.

* * * * *